US012222150B2

(12) United States Patent
Kim

(10) Patent No.: US 12,222,150 B2
(45) Date of Patent: Feb. 11, 2025

(54) ICE MAKER AND REFRIGERATOR

(71) Applicant: LG Electronics Inc., Seoul (KR)

(72) Inventor: Yonghyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 159 days.

(21) Appl. No.: 17/871,106

(22) Filed: Jul. 22, 2022

(65) Prior Publication Data

US 2023/0026086 A1 Jan. 26, 2023

(30) Foreign Application Priority Data

Jul. 22, 2021 (KR) ..... 10-2021-0096379
Jul. 22, 2021 (KR) ..... 10-2021-0096380
Jul. 22, 2021 (KR) ..... 10-2021-0096381

(51) Int. Cl.
*F25C 5/08* (2006.01)
*F25C 1/04* (2018.01)

(52) U.S. Cl.
CPC . *F25C 5/08* (2013.01); *F25C 1/04* (2013.01)

(58) Field of Classification Search
CPC ..... F25C 5/08; F25C 1/04
See application file for complete search history.

(56) References Cited

U.S. PATENT DOCUMENTS

2009/0026349 A1 1/2009 Shoukyuu et al.
2013/0081412 A1 4/2013 Son et al.
2014/0165618 A1 6/2014 Culley et al.
2019/0145686 A1 5/2019 Kim
2020/0158401 A1* 5/2020 Kim ..... F25C 1/243

FOREIGN PATENT DOCUMENTS

| | | | | |
|---|---|---|---|---|
| CN | 209819948 | | 12/2019 | |
| DE | 102009002223 | A1 * | 10/2010 | ..... F25C 5/08 |
| KR | 2017052100 | A * | 5/2017 | ..... F25C 1/18 |
| KR | 20170052100 | | 5/2017 | |
| KR | 101850918 | | 5/2018 | |
| KR | 2018090240 | A * | 8/2018 | ..... F25C 1/22 |

OTHER PUBLICATIONS

Translated_Won (Year: 2017).*
Translated_Peter (Year: 2010).*
Translated_Dong (Year: 2018).*
Extended European Search Report in European Appln. No. 22186416.8, dated Nov. 10, 2022, 8 pages.
Notice of Allowance in European Appln. No. 22186416.8, mailed on Jan. 26, 2024, 5 pages.
Office Action in U.S. Appl. No. 18/105,038, mailed on Mar. 13, 2024, 25 pages.

* cited by examiner

*Primary Examiner* — Elizabeth J Martin
*Assistant Examiner* — Samba Nmn Gaye
(74) *Attorney, Agent, or Firm* — Fish & Richardson P.C.

(57) ABSTRACT

A refrigerator includes a cabinet forming a storage space, a door configured to open or close the storage space, and an ice maker provided in the storage space or the door. The ice maker includes an upper tray including an upper chamber forming an upper portion of an ice chamber, a lower tray including a lower chamber forming a lower portion of the ice chamber, and an upper heater disposed along a circumference of the upper chamber so that at least two heating regions are formed at different positions in a vertical direction in the upper chamber.

21 Claims, 20 Drawing Sheets

Simulated heat distribution in an upper ice chamber
(RELATED ART)

Simulated heat distribution in an upper ice chamber

ICE MAKER AND REFRIGERATOR

CROSS-REFERENCE TO RELATED APPLICATION

The present application claims priority under 35 U.S.C. § 119 and 35 U.S.C. § 365 to Korean Patent Application No. 10-2021-0096379, filed in Korea on Jul. 22, 2021, Korean Patent Application No. 10-2021-0096380, filed in Korea on Jul. 22, 2021, and Korean Patent Application No. 10-2021-0096381, filed in Korea on Jul. 22, 2021, which are hereby incorporated by reference in their entirety.

FIELD

The present disclosure relates to an ice maker and a refrigerator.

BACKGROUND ART

In general, a refrigerator is a home appliance for storing foods at a low temperature in a storage space that is covered by a door. Such a refrigerator may use cold air to cool the inside of the storage space, thereby keeping stored foods in a refrigerated or frozen state.

Typically, an ice maker for making ice is provided inside the refrigerator. The ice maker is configured to make ice by receiving water supplied from a water supply source or a water tank in a tray for ice making. In addition, the ice maker is configured to separate ice from an ice tray by a heating method or a twisting method.

The ice maker that automatically supplies water and separates ice as described above is formed to open upward and scoops up the ice. The ice made in the ice maker having the above-described structure has at least a flat surface, such as a crescent shape or a cubic shape.

On the other hand, when the ice is formed in a spherical shape, it can be more convenient to use the ice and it is possible to provide a different feeling of use to a user. In addition, even when the ice is stored, the contact area between the ices is minimized to prevent the ice from sticking together.

An ice maker is disclosed in Korean Patent Registration No. 10-1850918, which is a prior art document. The ice maker disclosed in the Korea Patent Registration No. 10-1850918 includes an upper tray in which a plurality of hemispherical upper cells (or chambers, hereinafter the same) are arranged, a plurality of hemispherical lower cells, a lower tray rotatably connected to the upper tray, a water supply tray provided above the upper tray to supply ice-making water, and a water supply guide configured to guide the water supplied from the water supply tray to the lower tray.

Like the ice maker disclosed in the Korea Patent Registration No. 10-1850918, in the case of an ice maker having a structure in which an upper tray and a lower tray are in contact to form an ice chamber, a process of separating the upper tray from the lower tray is performed in order to separate the generated ice.

During this ice separating process, ice may be attached to the inner surface of the upper tray by the adhesion between the inner surface of the upper tray and the ice. If the ice is separated only by physical force, it may cause damage to the ice.

Accordingly, the ice maker disclosed in the Korea Patent Registration No. 10-1850918 is provided with an upper heater for ice separation. That is, during the ice separating process, the upper heater heats the upper tray to melt the surface of the ice, so that the ice is separated from the upper tray.

However, if the entire surface of the upper cell is not heated uniformly, or if any portion of a region where the upper tray and the ice come in contact with each other is not sufficiently heated, a phenomenon in which the ice of the corresponding portion is damaged during the ice separating process may still occur as described above.

In addition, if the heating time of the upper tray is increased in order to prevent damage to the ice, damage caused by the adhesion between the ice and the upper tray may be prevented, but a relatively large amount of ice in the overheated region melts, resulting in a phenomenon in which a desired shape of ice cannot be obtained.

For example, like the ice maker disclosed in the Korea Patent Registration No. 10-1850918, when the upper heater heats only a specific position of the upper tray, the heating becomes less as the distance from the region where the heat is transferred from the upper heater increases, which may cause the above-described problems.

In addition, the thermal conductivity may vary depending on the material of the upper tray. When the upper tray is made of a material with low thermal conductivity, the above-described problems may be greater. This may act as a restriction to change the material of the upper tray.

SUMMARY

The present disclosure provides an ice maker and a refrigerator having a heating structure capable of uniformly transferring heat over an entire surface of an upper chamber for making ice.

Optionally or additionally, the present disclosure provides an ice maker and a refrigerator capable of making ice and separating ice without damage to the ice.

Optionally or additionally, the present disclosure provides an ice maker and a refrigerator having a heating structure capable of transferring heat even between adjacent ice chambers when a plurality of ice chambers for making ice are formed.

Optionally or additionally, the present disclosure provides an ice maker and a refrigerator capable of removing restrictions that occur during an ice-separating process in changing the material of the upper tray.

A refrigerator according to one aspect may include a cabinet forming a storage space, a door configured to open or close the storage space, and an ice maker provided in the storage space or the door.

The ice maker may include an upper tray including an upper chamber forming an upper portion of an ice chamber. The ice maker may further include a lower tray including a lower chamber forming a lower portion of the ice chamber. The ice maker may further include an upper heater disposed along a circumference of the upper chamber so that at least two heating regions are formed at different positions in a vertical direction in the upper chamber.

The ice maker may further include an upper case to which the upper tray is coupled. The lower tray may be rotatably supported to the upper case.

The heating region may include a first heating region and a second heating region formed below the first heating region.

A diameter of the upper chamber may decrease toward an upper side. A diameter of a portion of the upper chamber in which the first heating region is formed may be less than a diameter of a portion of the upper chamber in which the second heating region is formed.

The upper tray may further include a first heat transfer portion protruding upward from the upper chamber at a position corresponding to the first heating region and configured to transfer heat of the upper heater to the upper chamber, and a second heat transfer portion protruding from the upper chamber at a position corresponding to the second heating region and configured to transfer heat of the upper heater to the upper chamber.

The upper heat may include a first portion that is in contact with the first heat transfer portion, and a second portion that is in contact with the first heat transfer portion.

The second heat transfer portion may be formed to surround at least one region around the upper chamber.

A region where the first heat transfer portion and the upper chamber meet each other may form the first heating region, and a region where the second heat transfer portion and the upper chamber meet each other may form the second heating region.

The upper chamber may be provided in plurality.

The first heat transfer portion may be formed in each of the plurality of upper chambers, and at least one first heat transfer portion may be formed between a pair of the upper chambers adjacent to each other.

An upper end of the first heat transfer portion may come into contact with the upper heater when the upper case is coupled to the upper tray.

A first region where the first heat transfer portion is in contact with the upper chamber may be wider than a second region where the first heat transfer portion is in contact with the upper heater.

The first heat transfer portion may include a chamber contact portion extending from the upper chamber, and a heater contact portion extending upward from the chamber contact portion and having a horizontal length shorter than a horizontal length of the chamber contact portion.

The upper case may include a heater insertion portion disposed at a position corresponding to the first heat transfer portion and the second heat transfer portion and into which the upper heater is inserted so that the upper heater is exposed downward.

The heater insertion portion may include a first heater insertion portion into which the first heat transfer portion is inserted, and a second heater insertion portion into which the second heat transfer portion is inserted. The upper heater may be inserted into the first heater insertion portion and the second heater insertion portion.

A region of the upper heater inserted into the first heater insertion portion may be located above a region of the upper heater inserted into the second heater insertion portion.

The upper case may further include a tray opening through which an upper portion of the upper chamber passes when coupled to the upper tray, and an opening wall extending downward from at least a region of the tray opening.

The first heater insertion portion may protrude radially inward from an inner wall of the opening wall.

The second heater insertion portion may be formed in at least a region of a lower end of the opening wall.

The refrigerator may further include an auxiliary heat transfer portion extending outward from the second heat transfer portion in a radial direction of the upper chamber.

The upper tray may be made of a plastic material, and the lower tray may be made of an elastic material.

An ice maker according to another aspect may include an upper tray including an upper chamber forming an upper portion of an ice chamber, an upper case coupled to the upper tray from an upper side of the upper tray, a lower tray including a lower chamber forming a lower portion of the ice chamber in a state of being in contact with the upper chamber, and an upper heater disposed along a circumference of the upper chamber and coming in contact with two points having different heights from each other in the upper chamber.

The upper heater may be installed in the upper case.

The upper tray may include a first heat transfer portion extending upward from the upper chamber and coming in contact with the upper heater, and a second heat transfer portion extending upward from the upper chamber at a position spaced apart from the first heat transfer portion and coming in contact with the upper heater.

An upper end of the first heat transfer portion may be located higher than an upper end of the second heat transfer portion.

A region where the first heat transfer portion and the upper chamber meet each other may form a first heating region.

A region where the second heat transfer portion and the upper chamber meet each other may form a second heating region. The second heating region may be wider than the first heating region.

DETAILED DESCRIPTION OF THE EMBODIMENTS

Figure 1:
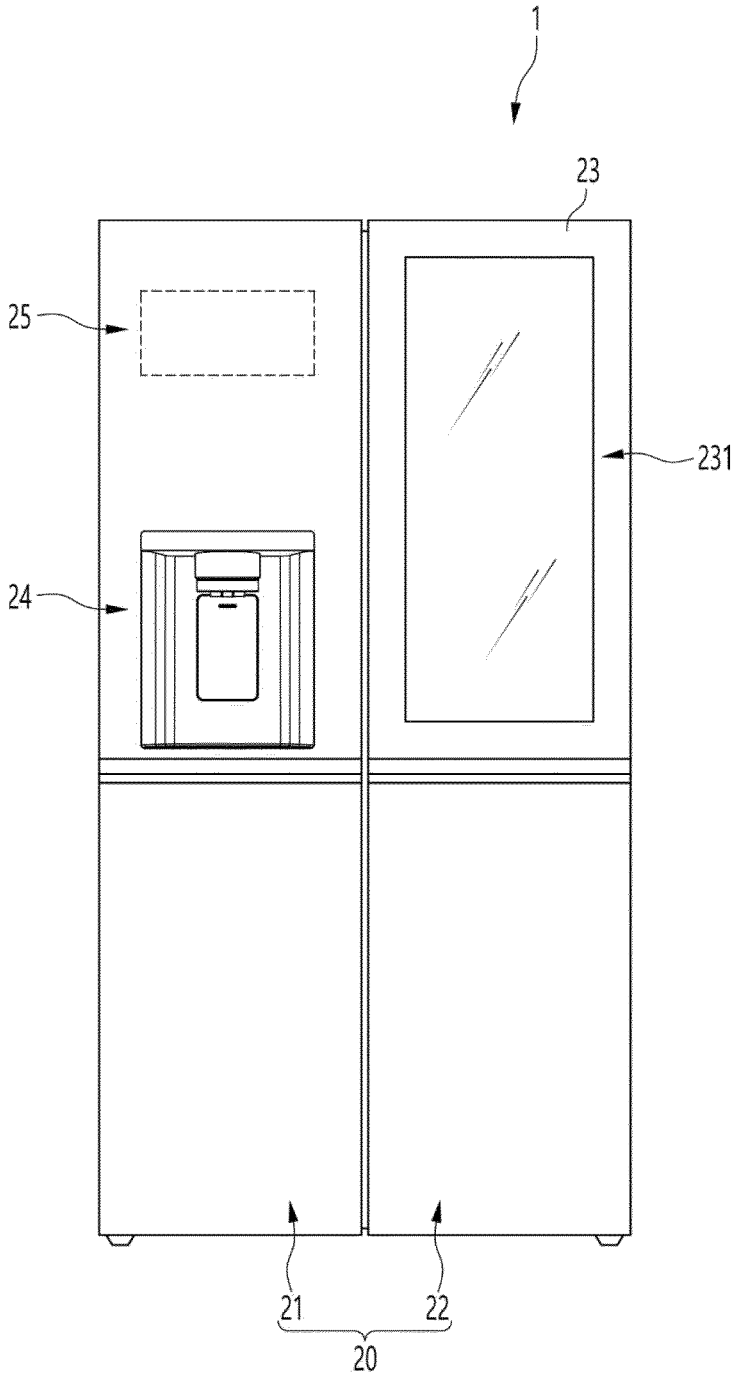
FIG. 1 is a perspective view of a refrigerator according to an embodiment of the present disclosure.

Advantages and features of the present invention, and methods of achieving them will be clarified with reference to embodiments described below in detail with reference to the accompanying drawings. In this regard, the embodiments of the present disclosure may have different forms and should not be construed as being limited to the descriptions set forth herein. Rather, these embodiments of the present disclosure are provided so that the present disclosure will be thorough and complete and will fully convey the concept of the embodiments of the present disclosure to those of ordinary skill in the art. The present disclosure is only defined by the scope of the claims. The same reference numerals denote the same elements throughout the specification.

Figure 2:
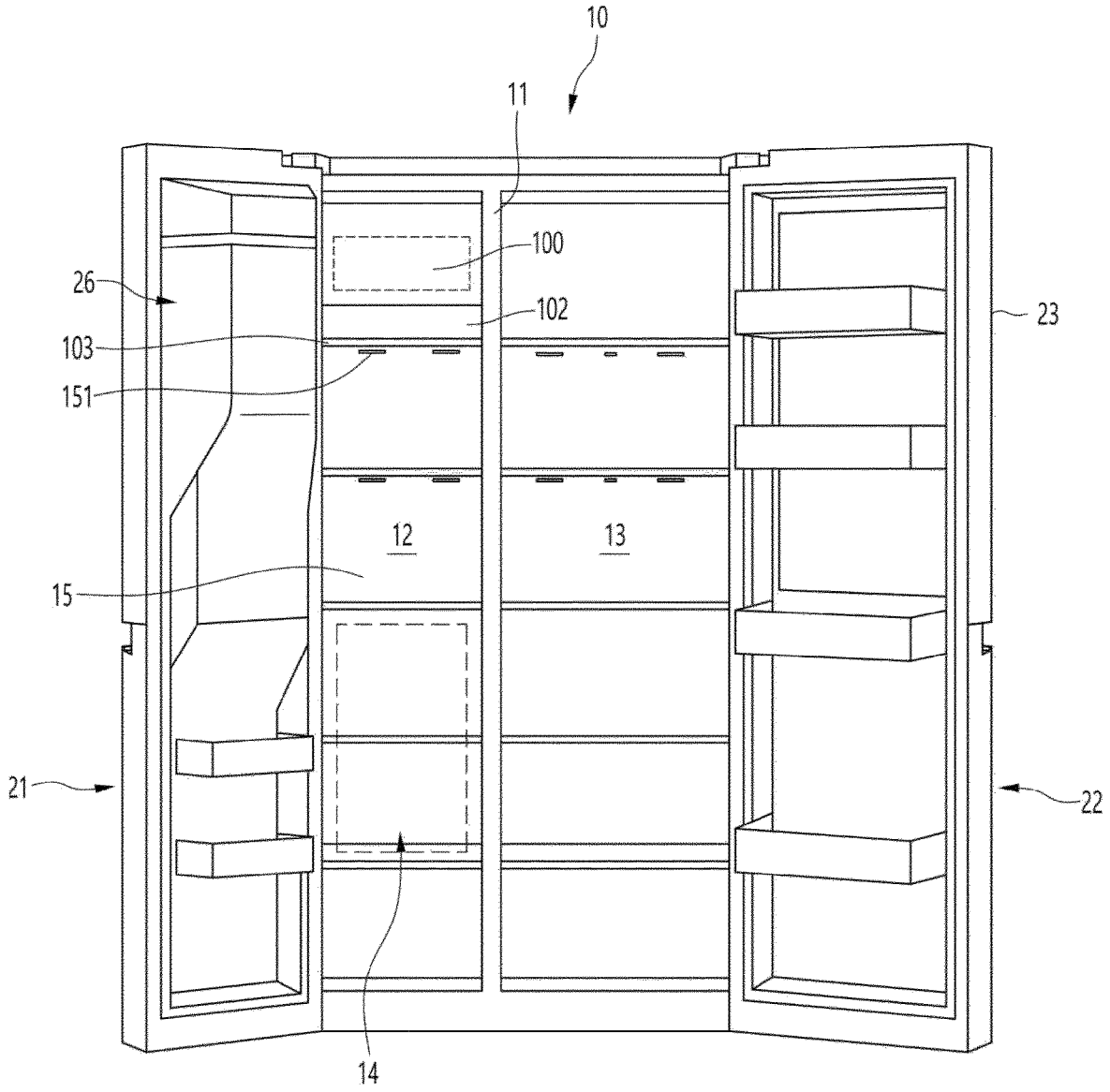
FIG. 2 is a perspective view showing a state in which a door of a refrigerator is opened, according to an embodiment of the present disclosure.

FIG. 1 is a perspective view of a refrigerator 1 according to an embodiment of the present disclosure. FIG. 2 is a perspective view showing a state in which a door 20 of the refrigerator 1 is opened, according to an embodiment of the present disclosure.

Referring to FIGS. 1 and 2, the refrigerator 1 according to an embodiment of the present disclosure may include a cabinet 10 for forming a storage space and a door 20 for opening or closing the storage space.

More specifically, as shown in FIG. 2, the cabinet 10 forms a storage space partitioned left and right by a barrier 11, a refrigerating compartment 13 is formed on the right side, and a freezing compartment 12 is formed at the other side thereof. Storage members such as drawers, shelves, and baskets may be provided inside the refrigerating compartment 13 and the freezing compartment 12 according to an embodiment of the present disclosure.

The door 20 according to an embodiment of the present disclosure may include a refrigerating compartment door 22 for shielding the refrigerating compartment 13 and a freezing compartment door 21 for shielding the freezing compartment 12. The arrangement of the refrigerating compartment 13 and the freezing compartment 12 and the shape of the door 20 may vary depending on the type of refrigerator, and the present disclosure is not limited thereto and may be applied to various types of refrigerators. For example, the freezing compartment 12 and the refrigerating compartment 13 may be vertically partitioned.

The doors 20 according to an embodiment of the present disclosure may be rotatably coupled to the cabinet 10 to open or close the refrigerating compartment 13 and the freezing compartment 12, respectively. As described above, the door 20 may include the refrigerating compartment door 22 for opening or closing the refrigerating compartment 13 and the freezing compartment door 21 for opening or closing the freezing compartment 12, and the refrigerating compartment door 22 may include a plurality of doors 22 and 23 arranged vertically.

On the other hand, the refrigerator 1 according to an embodiment of the present disclosure may further include a dispenser 24. The dispenser 24 is provided so that a user can take out water or ice. In an embodiment of the present disclosure, it is assumed that the dispenser 24 is disposed on the door 20, for example, the freezing compartment door 21. For convenience, it is assumed that the dispenser 24 is positioned above the freezing compartment door 21.

In addition, the refrigerator 1 according to an embodiment of the present disclosure includes a display assembly 231. The display assembly 231 corresponds to a configuration that allows the operating state of the refrigerator 1 to be displayed and allows a user to input a user's manipulation for the operation of the refrigerator 1.

For example, the display assembly 231 may be disposed on the door 20. In an embodiment of the present disclosure, it is assumed that the display assembly 231 is disposed on the refrigerating compartment door 22. For the convenience of the user, it is assumed that the display assembly 231 is disposed above the refrigerating compartment door 22.

On the other hand, an ice making chamber 26 in which a main ice maker 25 is accommodated may be formed in the freezing compartment door 21. The ice making chamber 26 may receive cold air from an evaporator 14 provided in the cabinet 10 so that ice can be made in the main ice maker 25.

The ice making chamber 26 and the dispenser 24 may communicate with each other so that the ice made by the main ice maker 25 can be taken out in the dispenser 24.

On the other hand, in the refrigerator 1 according to an embodiment of the present disclosure, an ice maker 100 may be installed in the freezing compartment 12 separately from the main ice maker 25. It is assumed that the ice maker 100 according to an embodiment of the present disclosure is disposed on an upper shelf 103 of the freezing compartment 12. As described above, since the upper case 230 of the ice maker 100, which will be described below, is fixed to the shelf 103, the ice maker 100 can be installed.

An ice bin 102 for storing ice made by the ice maker 100 may be provided under the ice maker 100. A plurality of outlet ports 151 through which the cold air generated by the evaporator 14 is guided may be formed below the shelf 103.

On the other hand, the freezing compartment 12 may include a duct through which cold air is supplied to the freezing compartment 12. Accordingly, a portion of the cold air generated by the evaporator 14 and supplied to the freezing compartment 12 may flow toward the ice maker to make ice through an indirect cooling method.

Of course, as other examples, the dispenser 24 and the main ice maker 25 may not be provided in the refrigerator 1, and the refrigerator 1 may include only the ice maker 100 according to the embodiment of the present disclosure. Instead of the main ice maker 25, the ice maker 100 may be provided in the ice making chamber 26.

Hereinafter, the ice maker 100 according to an embodiment of the present disclosure will be described in detail.

Figure 3:
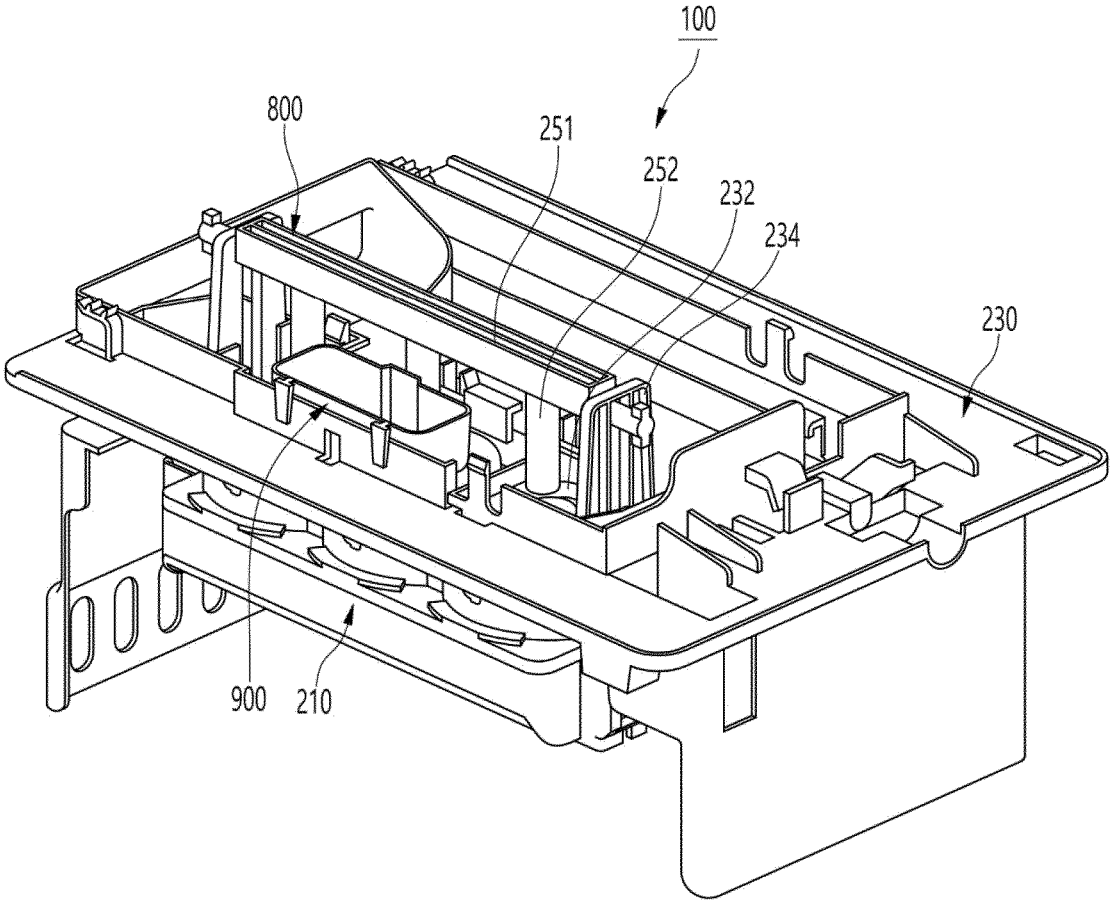
FIG. 3 is a perspective view of an ice maker according to an embodiment of the present disclosure.
Figure 4:
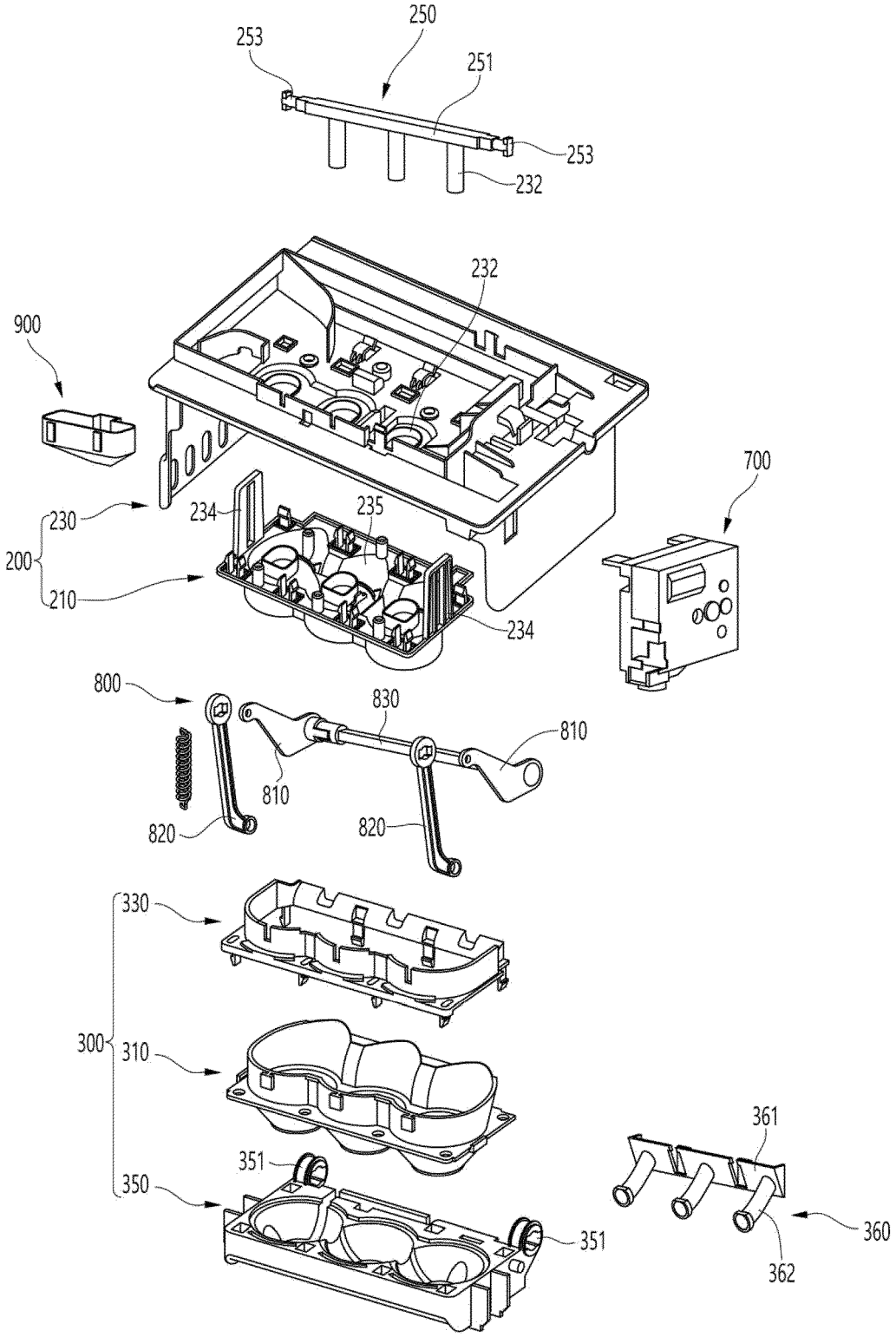
FIG. 4 is an exploded perspective view of the ice maker according to an embodiment of the present disclosure.
Figure 5:
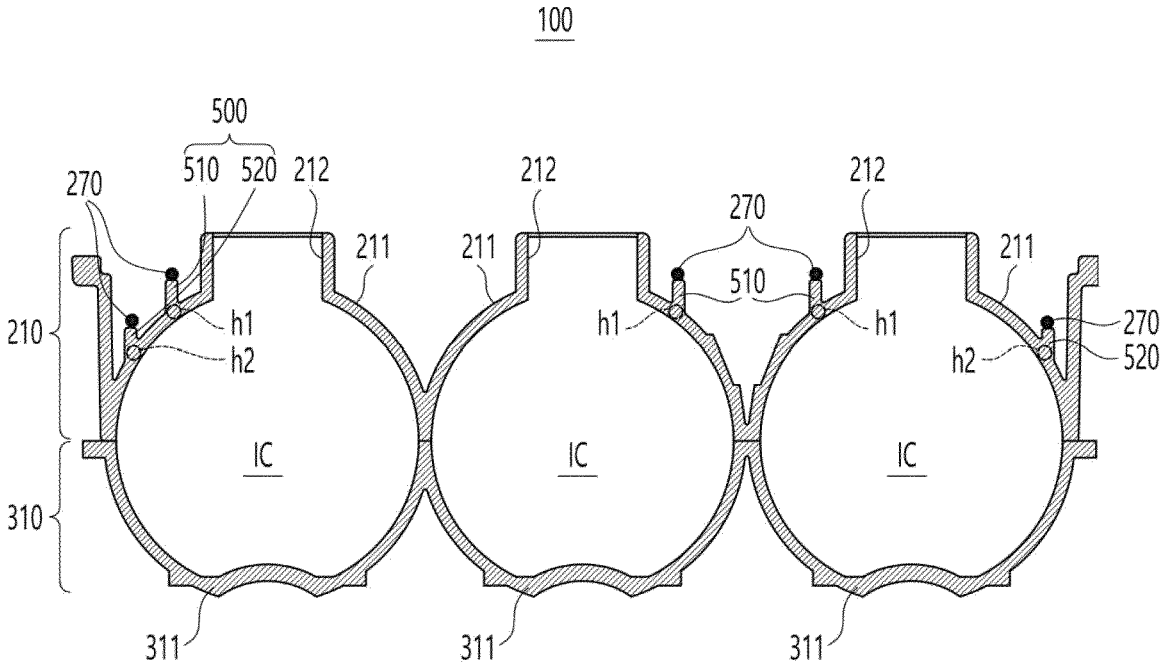
FIG. 5 is a cross-sectional view of an upper tray and a lower tray, which are components of the ice maker according to an embodiment of the present disclosure.

FIG. 3 is a perspective view of the ice maker 100 according to an embodiment of the present disclosure. FIG. 4 is an exploded perspective view of the ice maker 100 according to an embodiment of the present disclosure. FIG. 5 is a cross-sectional view of an upper tray 210 and a lower tray 310, which are components of the ice maker 100 according to an embodiment of the present disclosure. FIG.

6 is a plan view of the upper tray 210 of the ice maker 100, when viewed from above, according to an embodiment of the present disclosure.

Referring to the drawings, the ice maker 100 according to an embodiment of the present disclosure may include an upper tray 210, a lower tray 310, and an upper heater 270.

For the convenience of explanation and understanding, directions are defined. Hereinafter, a direction in which the upper tray 210 is formed is defined as an upper portion and a direction in which the lower tray 310 is formed is defined as a lower portion.

The upper tray 210 according to an embodiment of the present disclosure may include an upper chamber 211 forming an upper portion of an ice chamber IC. The upper tray 210 may be referred to as a first tray, and the upper chamber 211 may be referred to as a first chamber.

The lower tray 310 may include a lower chamber 311 forming a lower portion of the ice chamber IC when coming into contact with the upper tray 210. The lower tray 310 may be referred to as a second tray, and the lower chamber 311 may be referred to as a second chamber.

That is, the upper chamber 211 forms a portion of the upper side of the ice chamber IC, and the lower chamber 311 forms a portion of the lower side of the ice chamber IC. Therefore, when the upper tray 210 and the lower tray 310 come into contact with each other, the ice chamber IC for making ice may be formed.

In an embodiment of the present disclosure, it is assumed that three ice chambers IC are formed. The upper tray 210 is configured to include three upper chambers 211, and the lower tray 310 is also configured to include three lower chambers 311. However, of course, the technical spirit of the present disclosure is not limited to the number of ice chambers IC.

In addition, in the ice maker 100 according to an embodiment of the present disclosure, it is assumed that the ice chamber IC has a substantially spherical shape. It is assumed that the ice made in the ice chamber IC has a substantially spherical shape. Accordingly, the upper chamber 211 may have a substantially hemispherical shape, and the lower chamber 311 may also have a hemispherical shape.

The shape of the ice chamber IC according to an embodiment of the present disclosure is not limited to the example shown in FIG. 5. That is, the ice chamber IC may have various shapes that can be formed by the upper chamber 211 and the lower chamber 311 when the upper tray 210 and the lower tray 310 come into contact with each other.

For example, the cross-section of the ice chamber IC in the direction shown in FIG. 5 may have a racetrack shape or an elliptical shape. That is, the upper side and the lower side of the ice chamber IC may each have a round shape. As another example, of course, the upper chamber 211 may have a polygonal pyramid shape, and the lower chamber 311 may also have a polygonal pyramid shape.

The shape of the ice chamber IC, that is, the shape of the upper chamber 211 may be defined as a shape that is narrowed inward in a radial direction toward an upper direction. Similarly, the shape of the lower chamber 311 may be defined as a shape that is narrowed inward in a radial direction toward a lower direction. That is, a diameter of the upper chamber 211 may decrease toward the upper side. A diameter of the lower chamber 311 may decrease toward the lower side.

In the upper chamber 211, a diameter of a portion in which a first heating region h1 is formed is less than a diameter of a portion in which a second heating region h2 is formed.

Hereinafter, it is assumed that the ice chamber IC according to an embodiment of the present disclosure has a spherical shape, and the upper chamber 211 and the lower chamber 311 each have a hemispherical shape. In this case, the spherical or hemispherical shape may not be an ideal sphere or hemispherical shape in the dictionary meaning.

On the other hand, the upper heater 270 according to an embodiment of the present disclosure may heat the upper chamber 211. For example, the upper heater 270 heats the upper chamber 211 during an ice separating process of the ice maker 100 according to an embodiment of the present disclosure, and thus, the surface of the ice made in the ice chamber IC can be melted to enable smooth ice separation.

In an embodiment of the present disclosure, it is assumed that the upper heater 270 heats the upper chamber 211 so that at least two or more heating regions h1 and h2 are formed at different positions in the vertical direction, as shown in FIG. 5.

In an embodiment of the present disclosure, as shown in FIG. 5, although it is assumed that the heating regions h1 and h2 are formed at two different positions in the vertical direction, but the heating regions h1 and h2 may be formed at three or more different positions.

Hereinafter, it is assumed that the heating regions h1 and h2 according to an embodiment of the present disclosure are divided into two regions. The heating region formed on the upper side among the heating regions h1 and h2 is defined as a first heating region h1, and the heating region positioned below the first heating region h1 is defined as a second heating region h2.

According to the above configuration, the upper heater 270 forms the heating regions h1 and h2 at different positions in the vertical direction, so that it is possible to evenly heat over the entire region of the upper chamber 211.

This may eliminate a phenomenon in which ice is not sufficiently melted during ice separation because the regions relatively spaced apart from the heating regions h1 and h2 are not sufficiently heated. Accordingly, it is possible to prevent damage to the ice during ice separation and also to prevent the occurrence of residual ice in the upper chamber 211 due to the damage to the ice.

In addition, it is possible to make ice having a desired shape by removing a situation of excessive heating in order to prevent the ice from being damaged during ice separation.

Figure 6:
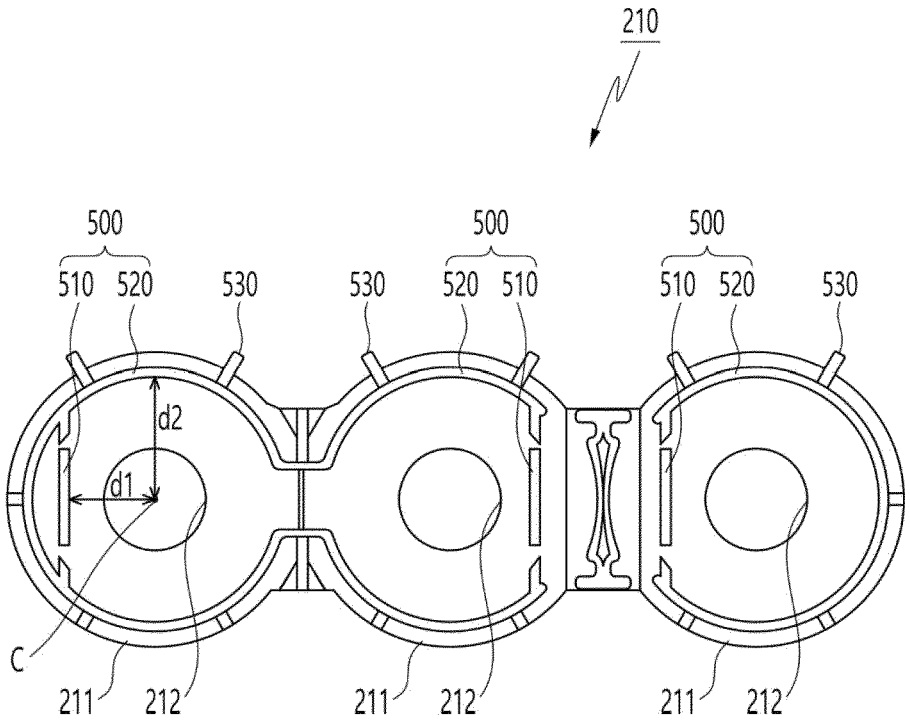
FIG. 6 is a plan view of the upper tray of the ice maker, when viewed from above, according to an embodiment of the present disclosure.

The upper tray 210 according to an embodiment of the present disclosure may be configured to further include a first heat transfer portion 510 and a second heat transfer portion 520 as shown in FIGS. 5 and 6.

The first heat transfer portion 510 according to an embodiment of the present disclosure is formed to protrude upward from the upper chamber 211 at a position corresponding to the first heating region h1 among the heating regions h1 and h2. The second heat transfer portion 520 is formed to protrude upward along the circumference of the upper chamber 211 at a position corresponding to the second heating region h2 among the heating regions h1 and h2.

The second heat transfer portion 520 according to an embodiment of the present disclosure may be formed to surround at least one region around the upper chamber 211. Accordingly, the second heating region h2 formed by the second heat transfer portion 520 may also be formed to surround at least one region around the upper chamber 211.

The first heating region h1 according to an embodiment of the present disclosure is located above the second heating region h2 in the vertical direction as shown in FIG. 5. Therefore, the first heat transfer portion 510 may be formed to protrude upward from the upper chamber 211 in the upper portion in the vertical direction than the second heat transfer portion 520.

The first heat transfer portion 510 may transfer heat of the upper heater 270 to the upper chamber 211. Similarly, the second heat transfer portion 520 may also transfer heat of the upper heater 270 to the upper chamber 211.

Therefore, a region where the first heat transfer portion 510 and the upper chamber 211 meet each other forms the first heating region h1 of the upper chamber 211 heated by the upper heater 270, and a region where the second heat transfer portion 520 and the upper chamber 211 meet each other forms the second heating region h2 of the upper chamber 211 heated by the upper heater 270.

The second heating region h2 may be formed to be wider than the first heating region h1.

The upper heater 270 may include a first portion corresponding to the first heating region h1 and a second portion corresponding to the second heating region h2.

The first portion and the second portion may be located at different heights. The first portion may be in contact with the first heat transfer portion 510. The second portion may be in contact with the second heat transfer portion 520.

As described above, the upper chamber 211 is provided in plurality. As shown in FIG. 2, at least one first heat transfer portion 510 is formed in each upper chamber 211. Therefore, at least one first heating region h1 may also be formed in each upper chamber 211.

In addition, it is assumed that at least one of the plurality of first heat transfer portions 510 formed to correspond to the plurality of upper chambers 211 is formed between a pair of adjacent upper chambers 211. In this manner, it is possible to solve the problem of ice damage and residual ice at the time of ice separation, which is caused by no heat transfer between the upper chambers 211 in the existing heater structure manufactured to cover the entirety of the plurality of upper chambers 211.

As described above, the upper chamber 211 has a shape that is narrowed radially inward toward the upper direction, for example, a hemispherical shape. According to the shape of the upper chamber 211, as shown in FIG. 6, the first heating region h1 may be formed radially inside the second heating region h2.

That is, a distance d1 from the center C of the upper chamber 211 to the first heating region h1 may be formed closer than a distance d2 to the second heating region h2.

Figure 7A:
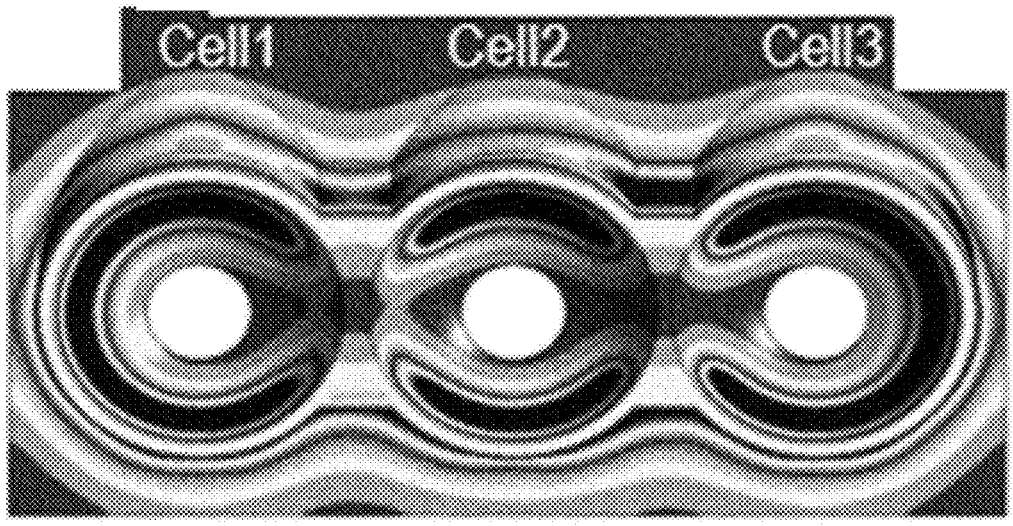
FIGS. 7A and 7B are images obtained by simulating heat distribution of an upper chamber when the upper chamber is heated with the same amount of heat from a heater.
Figure 7B:
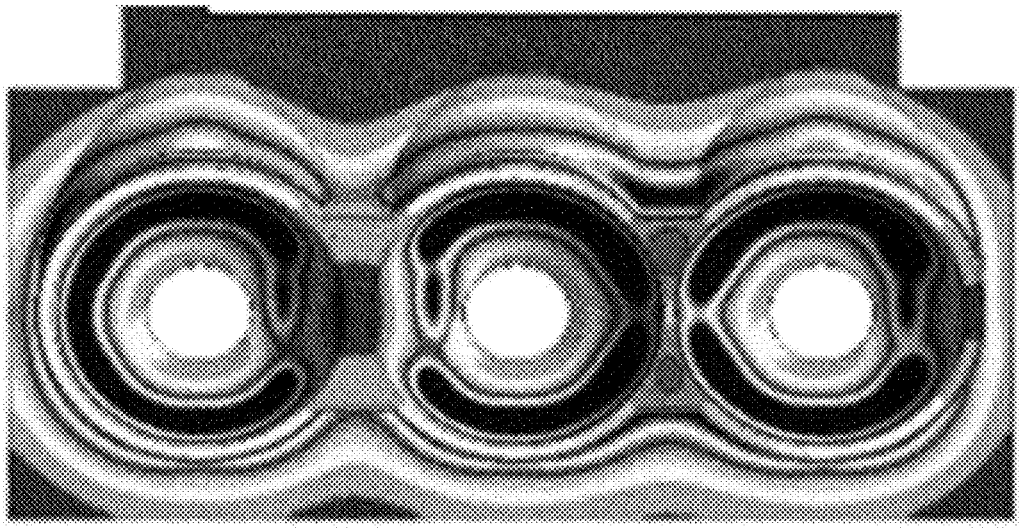

FIGS. 7A and 7B are images obtained by simulating heat distribution of the upper chamber 211 when the upper chamber 211 is heated with the same amount of heat from a heater. FIG. 7A is an image obtained by simulating heat distribution in a conventional heater structure. That is, FIG. 7A is an image obtained by simulating a structure in which conventional heaters are arranged along a circumference of a chamber in the form of one row at a constant height in the vertical direction. FIG. 7B is an image obtained by simulating heat distribution in the structure of the upper heater 270 according to an embodiment of the present disclosure.

The conventional heater structure shown in FIG. 7A has a structure in which the heater is located at the same height in the vertical direction and completely surrounds the plurality of chambers. A region indicated in red in FIG. 7A may be understood as a region where a heater is disposed.

On the other hand, in the upper heater 270 according to an embodiment of the present disclosure, the positions of the first heat transfer portion 510 and the second heat transfer portion 520 in the vertical direction are different from each other, and at least one of the first heat transfer portions 510 is disposed between a pair of upper chambers 211 adjacent to each other.

In addition, as shown in FIG. 6, the first heat transfer portion 510 is located radially inside the second heat transfer portion 520. Accordingly, the first heating region h1 is located inside the radial direction, and the second heating region h2 is located outside the first heating region h1 in the radial direction.

Such structural characteristics are not only different in the position in the vertical direction, but also in the position in the plane direction based on the radial direction. When the upper chamber 211 is heated by the upper heater 270, it is possible to more uniformly transfer heat to the entire upper chamber 211.

Such an effect can be more clearly confirmed through the simulation result shown in FIGS. 7A and 7B.

As shown in FIG. 7A, in the conventional heater structure, it can be confirmed that heat transfer is not performed well toward the radial center of the chamber. In addition, it can be confirmed that heat transfer is not performed well even in the space between the chambers.

On the other hand, in the structure of the upper heater 270 according to the embodiment of the present disclosure, as shown in FIG. 7B, it can be confirmed that heat transfer occurs even near the inner center of the upper chamber 211 in the radial direction, for example, near the inlet port 212 of the upper chamber 211, compared to the conventional heater structure. In particular, it can be confirmed that sufficient heat transfer is performed even between the adjacent upper chambers 211.

Again, referring to FIGS. 3 and 4, the ice maker 100 according to an embodiment of the present disclosure may further include an upper case 230.

The upper case 230 according to an embodiment of the present disclosure may support the upper tray 210 and the lower tray 310. The upper tray 210 may be coupled to the upper case 230 from the lower side. That is, the upper tray 210 is coupled in the direction of the lower side of the upper case 230, so that the upper case 230 and the upper tray 210 may be configured as one assembly. The upper case 230 may be referred to as a first case.

Figure 8:
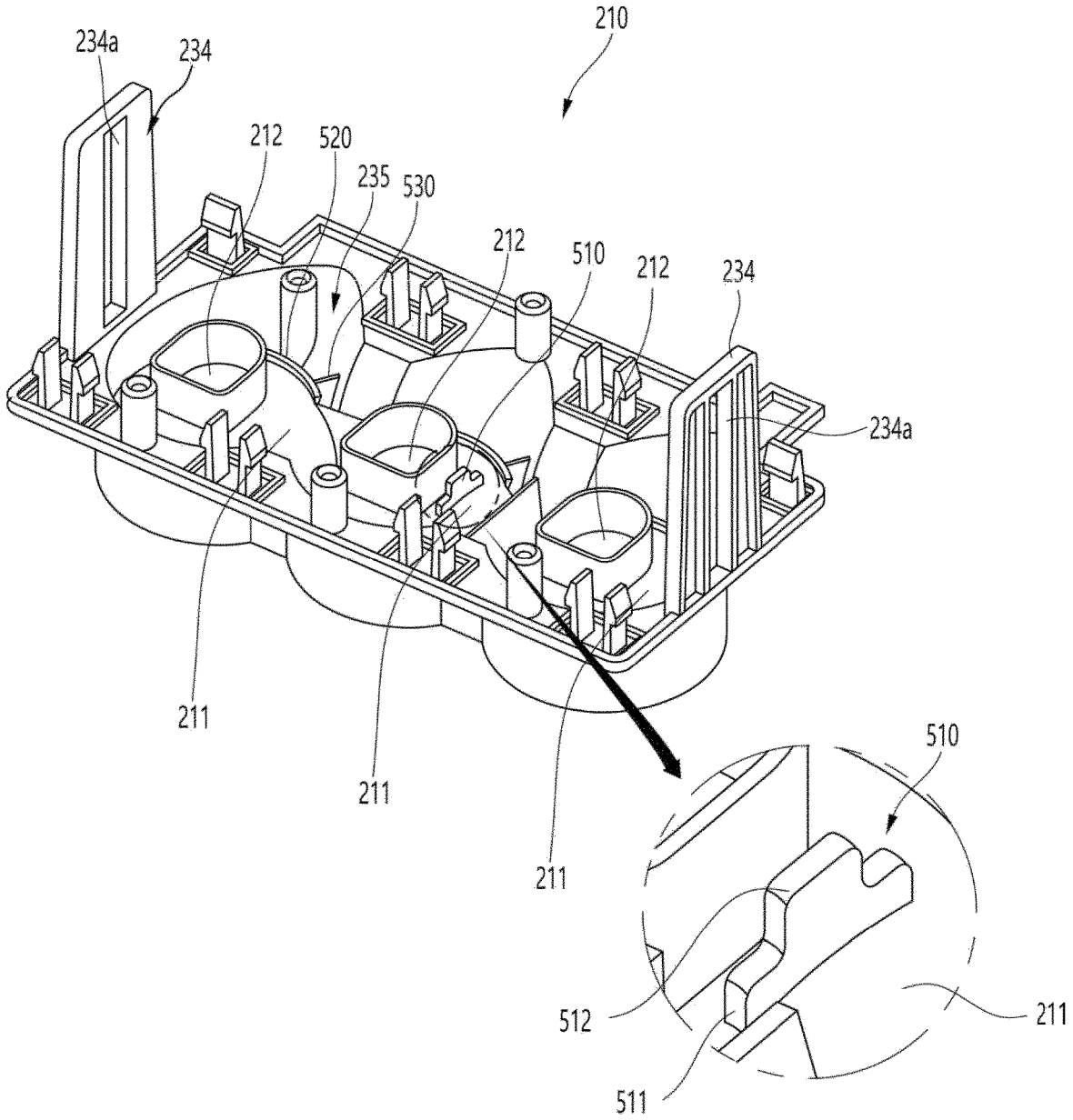
FIG. 8 is a perspective view, when viewed from above, showing an example of a specific configuration of an upper tray according to an embodiment of the present disclosure.
Figure 9:
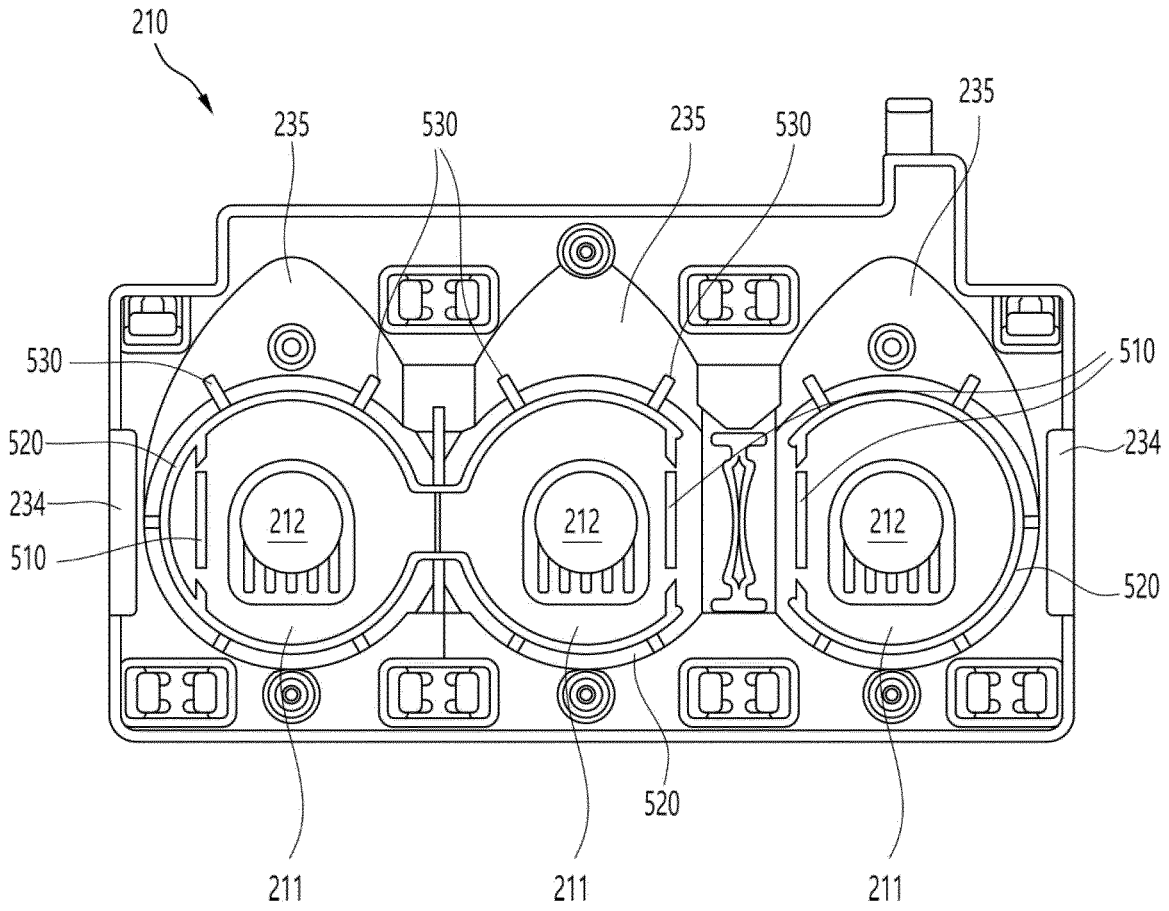
FIG. 9 is a plan view of the upper tray shown in FIG. 8, when viewed from above.
Figure 10:
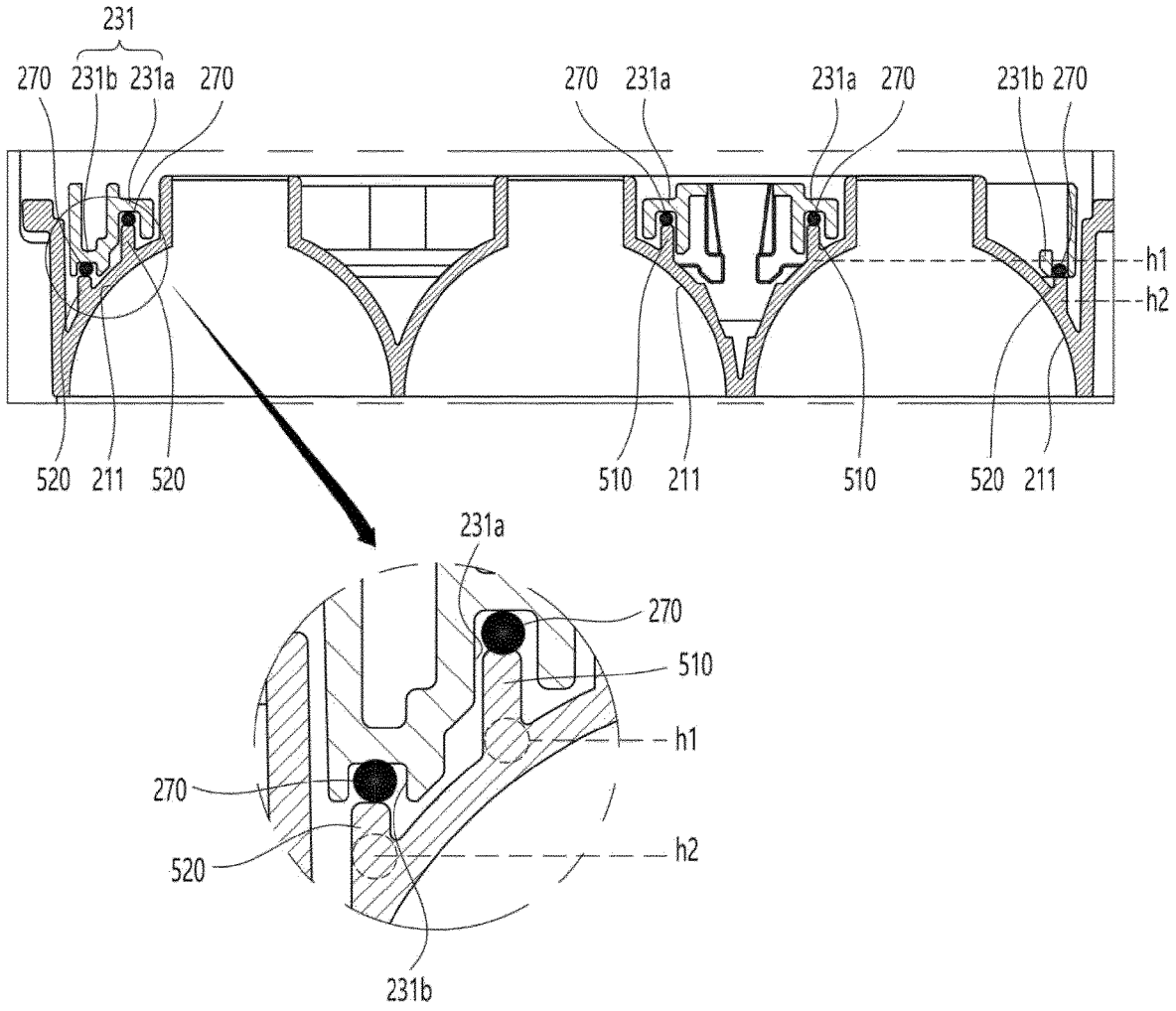
FIG. 10 is a cross-sectional view of the upper tray shown in FIG. 8.

FIG. 8 is a perspective view, when viewed from above, showing an example of a specific configuration of the upper tray 210 according to an embodiment of the present disclosure. FIG. 9 is a plan view of the upper tray 210 shown in FIG. 8, when viewed from above. FIG. 10 is a cross-sectional view of the upper tray 210 shown in FIG. 8.

Referring to the drawings, the upper end of the first heat transfer portion 510 according to an embodiment of the present disclosure is in contact with the upper heater 270 when the upper case 230 and the upper tray 210 are coupled to each other. Similarly, the upper end of the second heat transfer portion 520 is in contact with the upper heater 270 when the upper case 230 and the upper tray 210 are coupled to each other.

The first region where the first heat transfer portion 510 and the upper chamber 211 are in contact with each other, that is, the first heating region h1 may be formed to be wider than the second region where the first heat transfer portion 510 and the upper heater 270 is in contact with each other.

To this end, the first heat transfer portion 510 according to an embodiment of the present disclosure includes a chamber contact portion 511 and a heater contact portion 512 as shown in FIG. 8.

The chamber contact portion 511 according to an embodiment of the present disclosure may protrude upward from the upper chamber 211. The heater contact portion 512 is formed to extend upward from the chamber contact portion 511.

The chamber contact portion 511 and the heater contact portion 512 are integrally formed, and the horizontal length of the chamber contact portion 511 is longer than the horizontal length of the heater contact portion 512. Since a step (height difference) is formed between the two members, the first region may be formed to be wider than the second region.

With this configuration, when heat of the upper heater 270 is transferred to the upper chamber 211 through the first heat transfer portion 510, heat transfer is possible to the upper chamber 211 in a wider area. Such a structure can increase the heat transfer efficiency to the upper chamber 211 while reducing the size of the heater contact portion 512 in the design of the mechanical structure in which the heater contact portion 512 and the upper heater 270 are in contact with each other, thereby providing the effect of reducing design constraints.

In the embodiment of the present disclosure, it is assumed that the length of the chamber contact portion 511 is formed lengthwise. However, of course, heat transfer efficiency can be increased by forming the thickness in the plate surface direction to be thicker toward the upper chamber 211.

Figure 11:
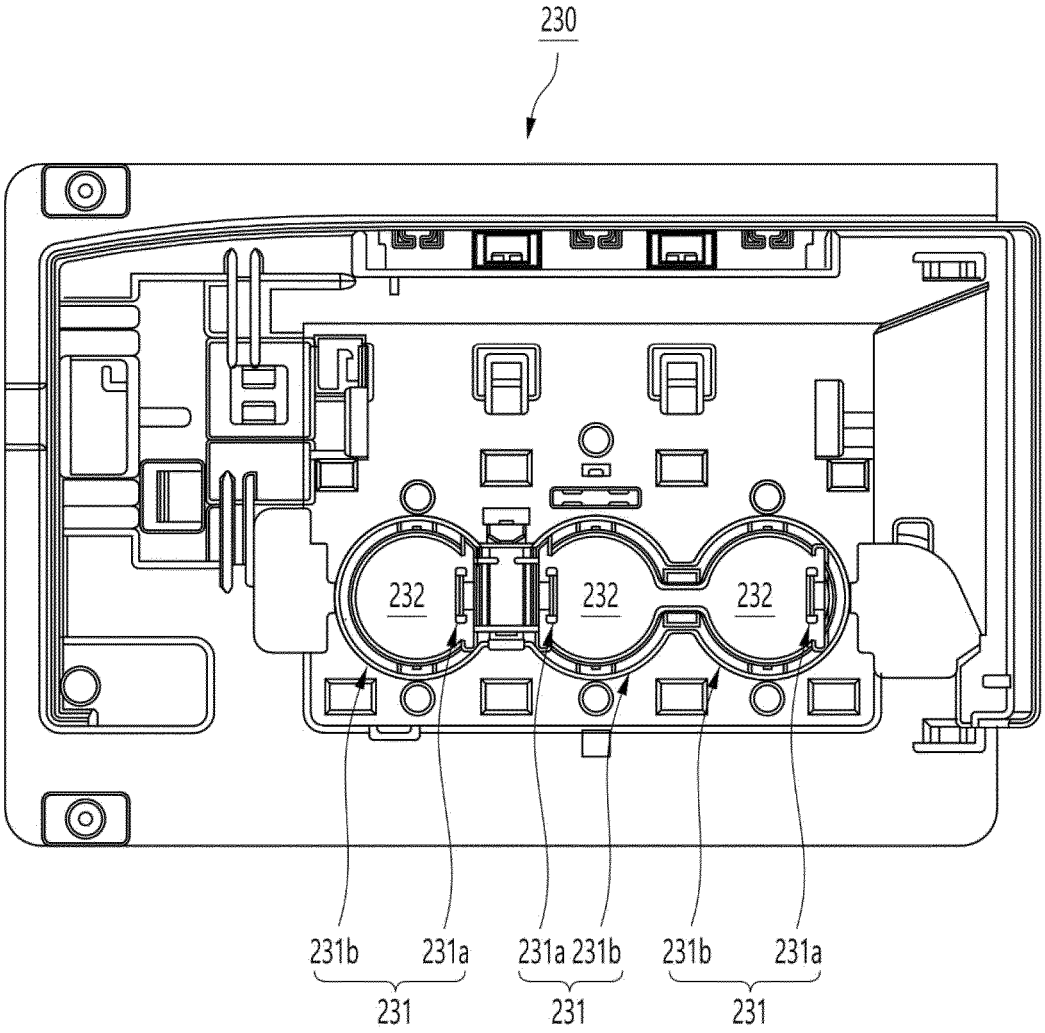
FIG. 11 is a plan view showing an upper case, when viewed from below, according to an embodiment of the present disclosure.
Figure 12:
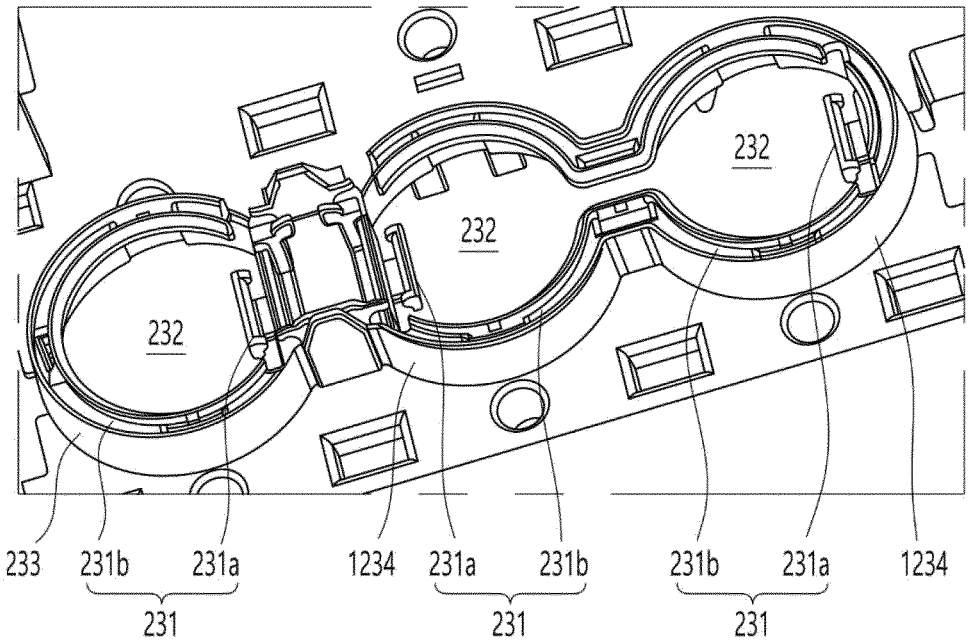
FIG. 12 is a partial perspective view showing the upper case, when viewed from below, according to an embodiment of the present disclosure.

On the other hand, FIG. 11 is a plan view showing the upper case 230, when viewed from below, according to an embodiment of the present disclosure. FIG. 12 is a partial perspective view showing the upper case 230, when viewed from below, according to an embodiment of the present disclosure.

Referring to the drawings, in an embodiment of the present disclosure, the upper heater 270 may be installed in the upper case 230. To this end, the upper case 230 according to an embodiment of the present disclosure may further include a heater insertion portion 231 into which the upper heater 270 is inserted.

The heater insertion portion 231 according to an embodiment of the present disclosure may be formed at a position corresponding to the first heat transfer portion 510 and the second heat transfer portion 520, and the upper heater 270 may be inserted so that the upper heater 270 is exposed downward.

When the upper case 230 and the upper tray 210 are coupled to each other, the upper ends of the first heat transfer portion 510 and the second heat transfer portion 520 are inserted into the heater insertion portion 231. Therefore, the upper ends of the first heat transfer portion 510 and the second heat transfer portion 520 come into contact with the upper heater 270.

The heater insertion portion 231 according to an embodiment of the present disclosure may include a first heater insertion portion 231*a* into which the first heat transfer portion 510 is inserted, and a second heater insertion portion 231*b* into which the second heat transfer portion 520 is inserted.

The upper heater 270 may be inserted across the first heater insertion portion 231*a* and the second heater insertion portion 231*b*. At this time, the region of the upper heater 270 inserted into the first heater insertion portion 231*a* is formed to be higher than the region of the upper heater 270 inserted into the second heater insertion portion 231*b* in the vertical direction. Therefore, as shown in FIG. 8, a structure in which the upper heater 270 is located at a different position in the vertical direction on the cross-section can be formed.

More specifically, the upper case 230 according to an embodiment of the present disclosure may further include a tray opening 232 and an opening wall 233.

When the tray opening 232 according to an embodiment of the present disclosure is coupled to the upper tray 210, one region of the upper portion of the upper chamber 211 may pass therethrough. The opening wall 233 may extend downward from at least one region of the tray opening 232.

The first heater insertion portion 231*a* may be formed to protrude inward in the radial direction from the inner wall of the opening wall 233, and the second heater insertion portion 231*b* may be formed in one region of the lower end of the opening wall 233.

That is, the second heater insertion portion 231*b* is formed at the lower end of the opening wall 233, and the first heater insertion portion 231*a* is formed on the inner wall surface of the opening wall 233. The regions where the upper heater 270 inserted across the first heater insertion portion 231*a* and the second heater insertion portion 231*b* is disposed at different positions in the vertical direction may be formed, and thus, an arrangement on the cross-section shown in FIG. 10 is possible.

In addition, the first heater insertion portion 231*a* protrudes inward from the opening wall 233, and the second heater insertion portion 231*b* is formed at the lower end of the opening wall 233. Therefore, as described above, the upper heaters 270 may be disposed in a region adjacent to the center of the upper chamber 211 in the radial direction and the outer side from the center, respectively.

On the other hand, the upper tray 210 of the ice maker 100 according to an embodiment of the present disclosure may further include an auxiliary heat transfer portion 530.

As shown in FIGS. 8 and 9, the auxiliary heat transfer portion 530 according to an embodiment of the present disclosure may be formed to extend radially outward from the second heat transfer portion 520. The auxiliary heat transfer portion 530 may extend from the second heat transfer portion 520 and may be connected to one region of the upper tray 210.

Accordingly, heat transferred from the upper heater 270 to the second heat transfer portion 520 is transferred to one region of the upper tray 210 through the auxiliary heat transfer portion 530, thereby preventing residual ice from occurring in a region other than the upper chamber 211, for example, one region of the upper tray 210 around the upper chamber 211.

In an embodiment of the present disclosure, it is assumed that a recessed portion 235 recessed in the downward direction is formed on the plate surface of the upper tray 210. For example, it is assumed that the upper chamber 211 is disposed in the recessed portion 235 formed in the upper tray 210.

It is assumed that the auxiliary heat transfer portion 530 is connected from the second heat transfer portion 520 of the upper chamber 211 disposed inside the recessed portion 235 to the inner wall surface of the recessed portion 235 through the recessed portion 235 and transfers heat through the inner wall surface of the recessed portion 235.

As described above, in an embodiment of the present disclosure, it is assumed that a plurality of upper chambers 211, for example, three upper chambers 211 are formed. It is assumed that a plurality of auxiliary heat transfer portions 530 are formed at regular intervals along the circumference of each upper chamber 211 in the recessed portion 235.

The upper tray 210 according to an embodiment of the present disclosure is made of a general plastic resin material used for injection molding. For example, the upper tray 210 may be made of a general thermoplastic resin or thermosetting resin material.

The plastic material has a lower thermal conductivity than an elastic material of the lower tray 310, for example, a silicone material. However, as described above, the upper heater 270 according to an embodiment of the present disclosure may heat the upper tray 210 in the first heating region h1 and the second heating region h2 to thereby evenly heat the entire surface of the upper tray 210. Therefore, injection molding of the upper tray 210 through a plastic material is possible. This provides an effect of reducing the manufacturing cost and manufacturing time of the upper tray 210.

On the other hand, the upper tray 210 may further include a pair of upper supporters 234 respectively formed on both side ends.

The upper supporter 234 may be connected to an upper ejector 250 to guide the vertical movement of the upper ejector 250. In an embodiment of the present disclosure, it is assumed that a guide slot 234*a* is formed in the upper supporter 234 in the vertical direction, and a separation prevention protrusion 253 of the upper ejector 250 is guided while being inserted into the guide slot 234*a* to guide the vertical movement.

Again, referring to FIGS. 3 and 4, the ice maker 100 according to an embodiment of the present disclosure may further include a lower supporter 350 and a lower case 330.

The lower supporter 350 according to an embodiment of the present disclosure may support the lower side of the lower tray 310. The lower case 330 may cover the upper side of the lower tray 310.

That is, the lower case 330, the lower tray 310, and the lower supporter 350 may be sequentially arranged in the vertical direction, and a fastening member may be fastened to constitute one assembly. One assembly is rotated by a driving unit 700 to be described below, so that the lower tray 310 may come into contact with the upper tray 210 or may be rotated apart from the upper tray 210.

Hereinafter, the assembly constituted by the upper tray 210 and the upper case 230 is defined as the upper assembly 200, and the assembly constituted by the lower case 330, the lower tray 310, and the lower supporter 350 is defined as the lower assembly 300.

The lower assembly 300 according to an embodiment of the present disclosure may be rotatably mounted to one end of the upper assembly 200. In an embodiment of the present disclosure, it is assumed that the lower assembly 300 is rotatably coupled to the upper case 230 of the upper assembly 200. The upper case 230 rotates the lower assembly 300 in a forward and reverse direction to rotatably support between an ice making position at which the lower tray 310 is in contact with the upper tray 210 and an ice separation position at which the lower tray 310 is spaced apart from the upper tray 210.

The ice maker 100 according to an embodiment of the present disclosure may further include a driving unit 700 that rotates the lower assembly 300 so that the lower assembly 300 is rotatable with respect to the upper assembly 200. For example, the driving unit 700 may include a motor and one or more gears for transmitting rotational force of the motor.

As described above, in a state where the lower tray 310, the lower assembly 300, and the driving unit 700 are installed in the upper case 230, the upper case 230 is mounted on the upper surface or shelf of the refrigerator to be described below, so that the ice maker 100 according to an embodiment of the present disclosure can be installed in the freezing compartment.

On the other hand, the ice maker 100 according to an embodiment of the present disclosure may further include a water supply guide 900. The water supply guide 900 may be installed on the upper side of the upper assembly 200 to supply water to the ice chamber IC formed by contacting the upper chamber 211 and the lower chamber 311.

When ice is made after water is supplied to the ice chamber IC through the water supply guide 900, the lower assembly 300 may be rotated in a forward direction. As the lower assembly 300 rotates, the lower tray 310 may be spaced apart from the upper tray 210 and ice made in the ice chamber IC may be separated and may fall into the ice bin to be described below.

In addition, the ice maker 100 according to an embodiment of the present disclosure may further include an upper ejector 250 for separating ice from the upper tray 210.

The upper ejector 250 according to an embodiment of the present disclosure may include an upper ejector body 251 and one or more upper ejecting fins 252 extending in a direction crossing the upper ejector body 251. The upper ejecting fins 252 may be provided in the same number as the number of ice chambers IC, and may separate ices made in the respective ice chambers IC.

Separation prevention protrusions 253 may be formed at both ends of the upper ejector body 251 according to an embodiment of the present disclosure. The separation prevention protrusion 253 is moved up and down along the guide slot 234*a* formed in the upper supporter 234 to be described below, and may be connected to one end of a link 820 (to be described below) connected to the lower assembly 300.

The upper ejector 250 moves up and down while interlocking with the rotation of the lower assembly 300 to separate the ice from the ice chamber IC. That is, in the process in which the upper ejecting fin 252 is introduced into the ice chamber IC through a case opening (to be described below) of the upper case 230 and the inlet port 212 of the upper tray 210, the ice chamber IC may be pressed to separate ice from the ice chamber IC.

In addition, the lower assembly 300 according to an embodiment of the present disclosure may further include a lower ejector 360. The lower ejector 360 may press the lower tray 310 of the lower assembly 300 so that ice in close contact with the lower chamber 311 of the lower tray 310 is separated from the lower chamber 311.

The end of the lower ejector 360 may be located within the rotation range of the lower assembly 300, and ice may be separated by pressing the lower outside of the ice chamber IC, that is, the lower chamber 311 during the rotation of the lower assembly 300.

The lower ejector 360 is installed in the upper case 230 so that the position thereof can be fixed regardless of the rotation of the lower assembly 300.

The lower ejector 360 according to an embodiment of the present disclosure includes a lower ejector body 361 fixed to the upper case 230 and a lower ejecting fin 262 protruding from the lower ejector body 361. The surface on which the lower ejecting fin 262 is formed may be inclined so that the lower ejecting fin 262 faces the lower opening 351 formed in the lower supporter 350 during the rotation of the lower assembly 300.

On the other hand, the rotation force of the lower assembly 300 may be transferred to the upper ejector 250 during the process of rotating the lower assembly 300 for ice separation. To this end, the ice maker 100 may further include a connecting unit 800 that connects the lower assembly 300 to the upper ejector 250. The connecting unit 800 may include one or more links 820.

The connecting unit 800 may include a pair of rotating arms 810 and a pair of links 820. The rotating arm 810 may be connected to the driving unit 700 together with the lower supporter 350 and may be rotated together.

The link 820 connects the lower supporter 350 to the upper ejector 250 to transmit the rotation force of the lower supporter 350 to the upper ejector 250 during the rotation of the lower supporter 350. As the upper ejector 250 moves up and down while interlocking with the rotation of the lower supporter 350 by the link 820, the upper ejecting fin 252 may press the ice in the ice chamber IC as described above. On the other hand, when the lower assembly 300 is rotated in the reverse direction, the upper ejector 250 may be raised by the connecting unit 800 to return to the original position thereof.

A connecting shaft 830 of the connecting unit 800 is connected to a hinge shaft 331 of the lower case 330 to be described below, and transmits the rotation of the driving unit 700 to the lower assembly 300.

On the other hand, as in the example described above, the lower tray 310 according to an embodiment of the present disclosure may be made of a flexible material or a soft material having elasticity that can be returned to the original shape thereof after being deformed by external force.

Therefore, when the lower tray 310 and the upper tray 210 come into contact with each other for ice making, the hardness of the lower tray 310 is lower than the hardness of the upper tray 210, and thus, the upper end of the lower tray 310 is deformed and the upper tray 210 and the lower tray 310 are pressed and airtightly contacted with each other.

For example, the lower tray 310 may be made of a silicone material. Since the lower tray 310 has a structure that is repeatedly deformed by direct contact with the lower ejector 360, the lower tray 310 may be easily deformed. Despite repeated ice formation, spherical ice can be made.

On the other hand, the ice maker 100 according to an embodiment of the present disclosure may further include a lower heater 370. The lower heater 370 may be installed adjacent to the lower chamber 311 so as to heat the lower chamber 311 of the lower tray 310 (see FIGS. 13 and 14). The operation process of the lower heater 370 will be described below.

Figure 13:
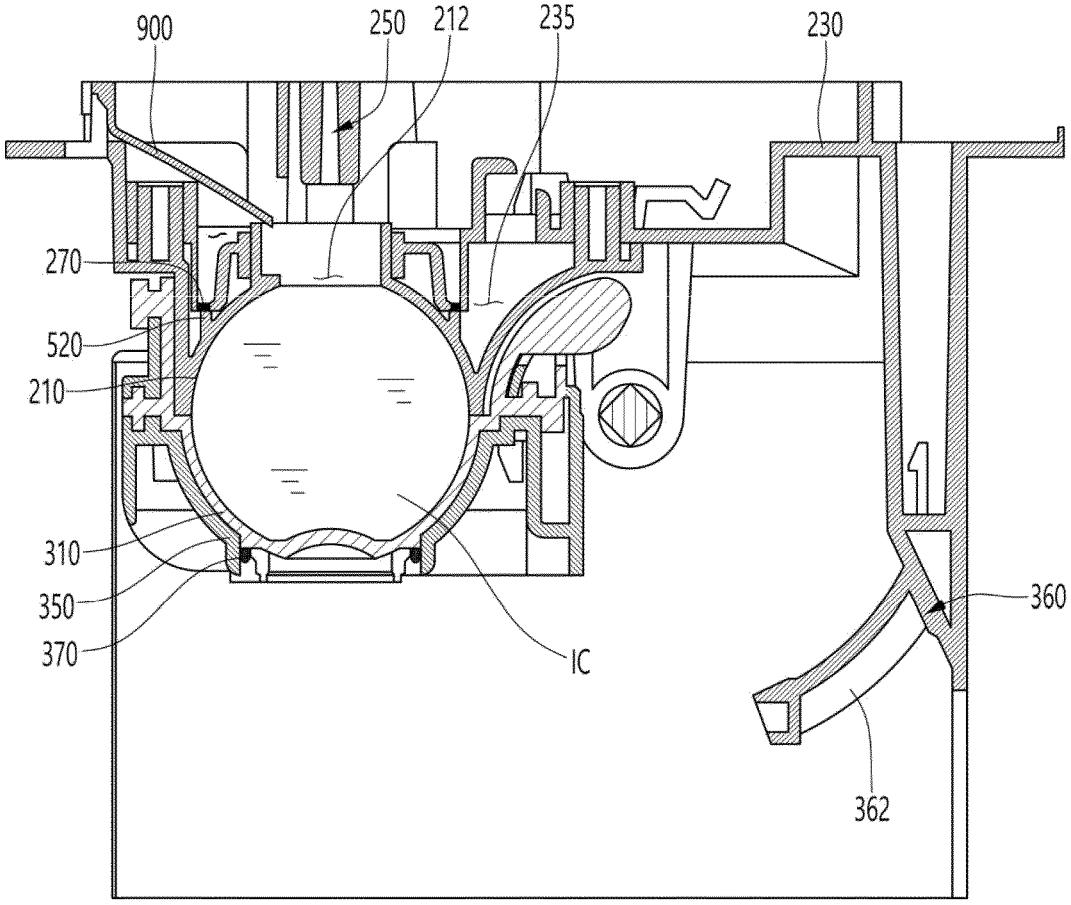
FIG. 13 is a view showing the states of the upper tray and the lower tray in which the water supply of the ice maker is completed, according to an embodiment of the present disclosure.
Figure 14:
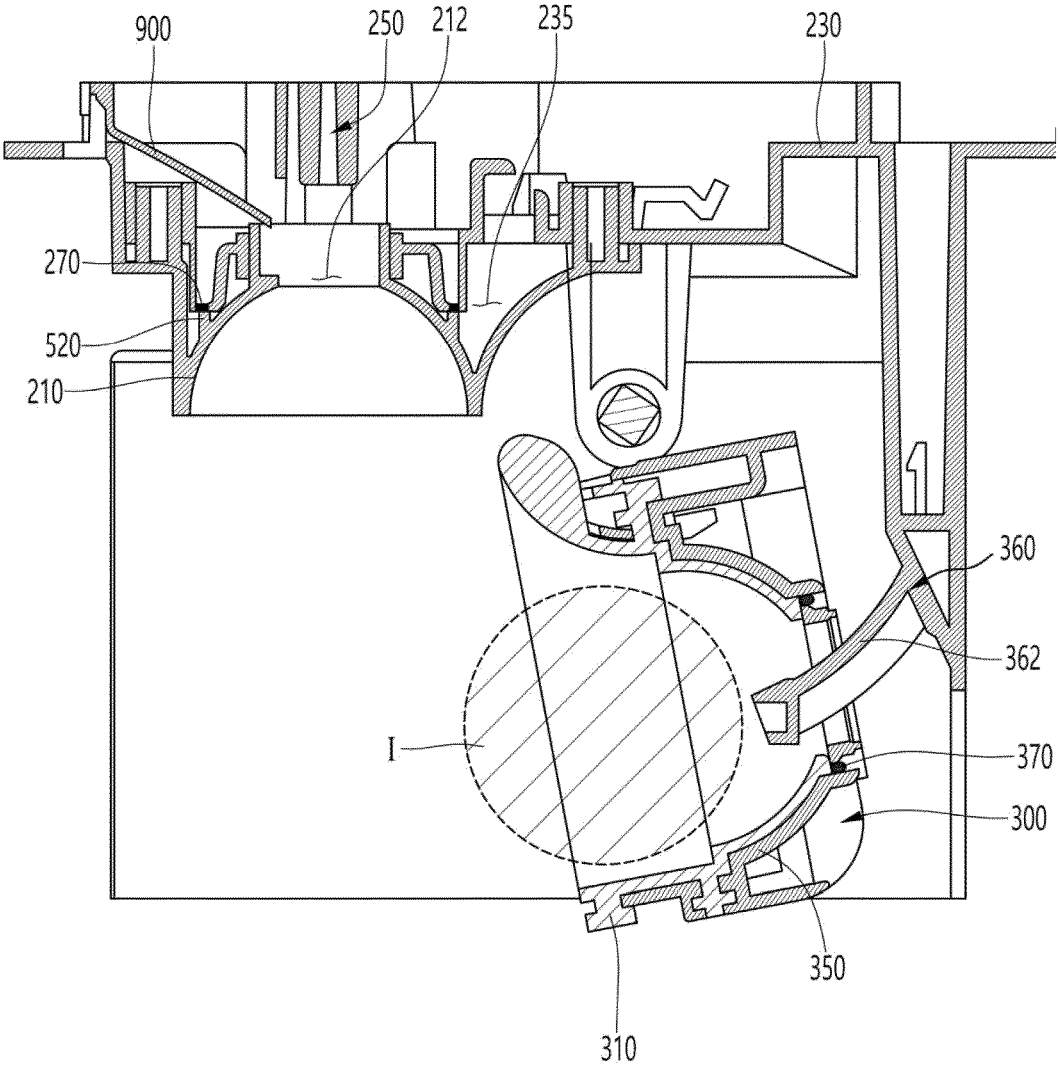
FIG. 14 is a view showing a state in which ice making of the ice maker is completed and the lower tray is rotated, according to an embodiment of the present disclosure.

Hereinafter, a basic operation of the ice maker 100 according to an embodiment of the present disclosure will be described with reference to FIGS. 13 and 14.

In the process of supplying water, the upper surface of the lower tray 310 is spaced apart from at least a portion of the lower surface of the upper tray 210, and water supplied from the outside is guided by the water supply guide 900 and is supplied to the ice chamber IC. In this case, water may be supplied to the ice chamber IC through one of the inlet ports 212 respectively formed in the plurality of upper chambers 211 of the upper tray 210.

The lower tray 310 and the upper tray 210 are spaced apart from each other, and thus, when a specific lower chamber 311 is filled with water during the process of supplying water, water flows into the neighboring lower chamber 311 to fill all the lower chambers 311. Accordingly, water may fill each of the plurality of lower chambers 311 of the lower tray 310.

On the other hand, when the supply of water is completed, the lower assembly 300 is rotated in the reverse direction by the driving unit 700, and the upper surface of the lower tray 310 is in contact with the lower surface of the upper tray 210. Thus, the upper tray 210 and the lower tray 310 are closed, and ice making is started.

When ice making is started, the lower heater 370 is turned on to heat the lower tray 310. Accordingly, ice is made from the uppermost side in the ice chamber IC. By controlling the output of the lower heater 370 to be variable according to the mass of water per unit height of the ice chamber IC, the ice may be sequentially frozen downward from the upper end of the ice chamber IC.

When the ice making is completed, the upper heater 270 and the lower heater 370 may be turned on so as to separate the ice. When the upper heater 270 and the lower heater 370 are turned on, heat of the upper heater 270 and the lower heater 370 is transferred to the upper chamber 211 and the lower chamber 311 by the first heat transfer portion 510 and the second heat transfer portion 520, and ice I may be separated from the inner surfaces of the upper chamber 211 and the lower chamber 311.

Thereafter, when the lower assembly 300 is moved in the forward direction, the lower tray 310 may be separated from the upper tray 210. During the process of rotating the lower assembly 300, the upper ejecting fin 252 presses the spherical ice in close contact with the upper tray 210, so that the ice may be separated from the upper tray 210. The ice separated from the upper tray 210 may be supported by the lower tray 310 again. The ice is moved together with the lower assembly 300 in a state of being supported by the lower tray 310, so that the ice may be separated from the lower tray 310 by the weight thereof and moved to the ice bin 102.

The ice maker and the refrigerator according to the present disclosure have one or more of the following effects.

First, the upper heater heats at least two different heating regions of the upper chamber in the vertical direction, so that heat transfer is possible over the entire surface of the upper chamber.

Second, an effect that can take out the spherical ice without damaging the spherical ice during the ice separating operation is provided through the uniform heat transfer over the entire upper chamber.

Third, the heating region is different in the vertical direction and is formed at different positions in the radial direction around the central axis of the upper chamber in the vertical direction, so that uniform heat transfer is possible over the entire upper chamber.

Fourth, since at least one heating region is formed between the plurality of upper chambers, it is possible to prevent damage to the spherical ice occurring between the upper chambers.

Fifth, the upper tray can be made of a general plastic material used in injection molding, without limitation to a silicone material that can implement an undercut structure, thereby providing an effect of reducing the manufacturing cost.

Sixth, when the upper tray is manufactured using a plastic material, an effect of removing the problem of ice damage during ice separation that may occur due to the adhesion between the plastic material and the ice through the heater structure is provided.

Hereinafter, a method for controlling the ice maker 100 according to an embodiment of the present disclosure will be described.

Figure 15:
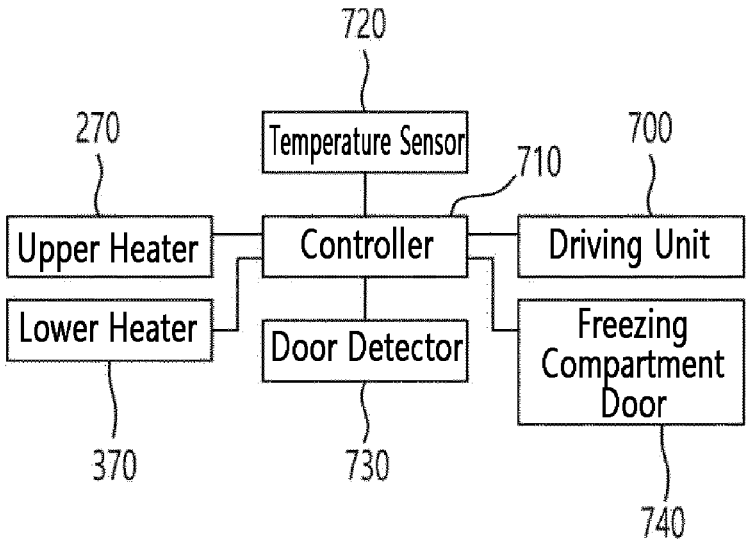
FIG. 15 is a block diagram of the ice maker according to an embodiment of the present disclosure.
Figure 16:
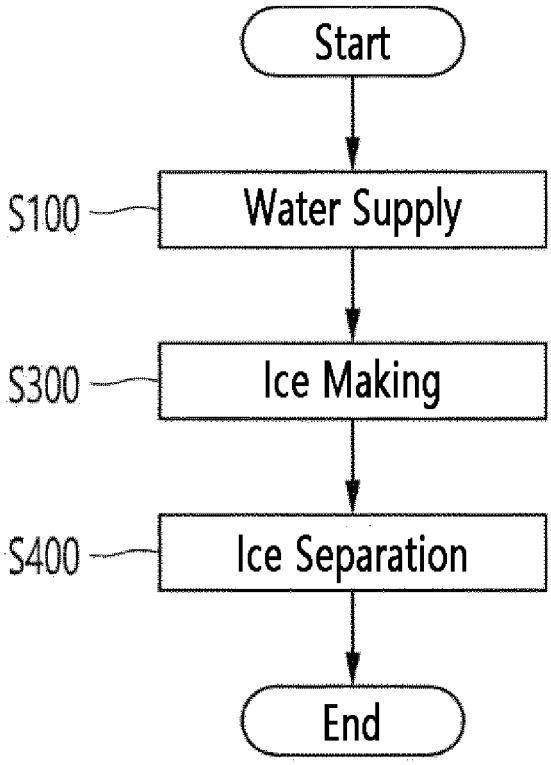
FIG. 16 is a flowchart for describing a process of making ice in the ice maker 100 according to an embodiment of the present disclosure.

FIG. 15 is a block diagram of the ice maker 100 according to an embodiment of the present disclosure. FIG. 16 is a flowchart for describing a process of making ice in the ice maker 100 according to an embodiment of the present disclosure.

The ice maker 100 according to an embodiment of the present disclosure may further include a controller 710 that controls the upper heater 270 and the lower heater 370 described above.

The controller 710 may determine whether the ice making is completed according to a temperature sensed by a temperature sensor 720.

The controller 710 may control on/off and output of the upper heater 270 and/or the lower heater 370. In an embodiment of the present disclosure, the controller 710 controls the output, that is, the amount of heat, through on/off duty control of the upper heater 270 and the lower heater 370. That is, the output of the upper heater 270 and/or the lower heater 370 may be controlled by adjusting on-time and off-time.

The controller 710 may turn on/off the current upper heater 270 and adjust the output when the door opening or closing is detected or a fan operation is detected during the ice making or ice separating process.

The controller 710 may control the driving unit 700 to rotate the lower assembly 300. Due to the rotation of the lower assembly 300, the upper ejector 250 connected to the lower assembly 300 moves down to separate ice from the upper assembly 200.

FIG. 16 is a flowchart for describing a process of making ice in the ice maker 100 according to an embodiment of the present disclosure.

More specifically, referring to FIG. 16, a water supply operation (S100) is performed first in order to make ice in the ice maker 100.

In more detail, in order to perform the water supply operation (S100), the lower assembly 300 rotates and the lower tray 310 moves to a water supply position.

The upper surface of the lower tray 310 is spaced apart from the lower surface of the upper tray 210 at the water supply position of the lower tray 310. In such a state, water supply is started and ice-making water is supplied to the ice chamber IC.

For example, water flows to the water supply guide 900 through a water supply pipe connected to an external water supply source of the refrigerator 1 or a water tank provided therein. Then, water is guided by the water supply guide 900 and is supplied to the ice chamber IC.

At this time, the upper surface of the lower tray 310 is spaced apart from the lower surface of the upper tray 210. Therefore, when the specific lower chamber 311 is filled with water during the water supply process, water may flow to the other lower chamber 311 along the upper surface of the lower tray 310. Accordingly, each of the plurality of lower chambers 311 of the lower tray 310 may be filled with water.

When the water supply is completed, the lower assembly 300 rotates to move the lower tray 310 to the ice making position. That is, the controller 710 may control the driving unit 700 to rotate the lower assembly 300 in the reverse direction. An ice making operation (S300) may be performed in a state where the lower tray 310 is moved to the ice making position.

In an embodiment of the present disclosure, after ice making is started, the controller 710 may control the lower heater 370 to operate to supply heat to the ice chamber in at least a partial period during the ice making operation (S300).

As an example, when the temperature sensed by the temperature sensor 720 reaches an on reference temperature, the control unit 710 may determine that the on condition of the lower heater 370 is satisfied, and may turn on the lower heater 370. When the lower heater 370 is turned on, heat of the lower heater 370 is transferred to the lower chamber 311 of the lower tray 310.

Therefore, when ice making is performed in a state where the lower heater 370 is turned on, heat is supplied to the water accommodated in the lower chamber 311 in the ice chamber IC. Therefore, ice may be made from above in the ice chamber IC. Air bubbles in the water may move downward to make transparent ice.

On the other hand, in an embodiment of the present disclosure, the controller 710 may determine whether ice making is completed, based on the temperature sensed by the temperature sensor 720. For example, when the controller 710 determines that the temperature of the upper tray 210 sensed by the temperature sensor 720 is less than or equal to an ice making completion temperature, for example, when the temperature is below −9° C., the controller 710 may determine that ice making is completed.

When the controller 710 determines that ice making is completed, the controller 710 may turn off the lower heater 370.

When the ice making is completed through the above process, the controller 710 performs an ice separating operation (S400).

Figure 17:
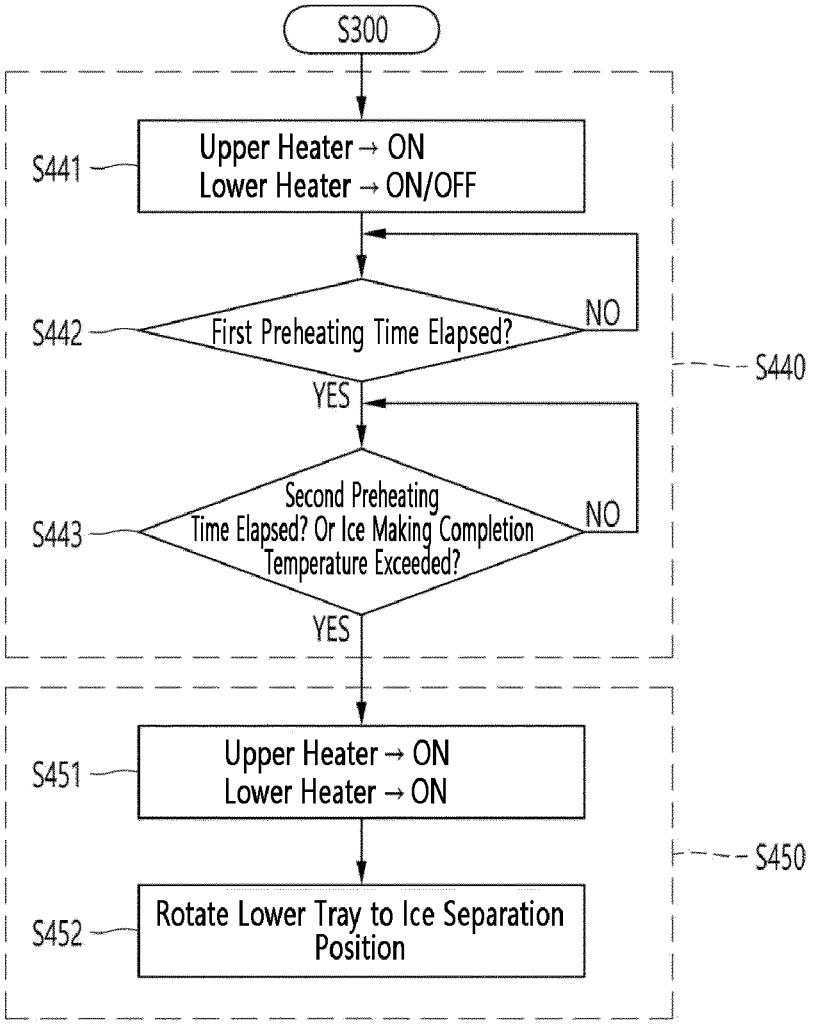
FIG. 17 is a flowchart for describing the ice separating operation according to an embodiment of the present disclosure.

FIG. 17 is a flowchart for describing the ice separating operation according to an embodiment of the present disclosure.

Referring to FIG. 17, the ice separating operation (S400) according to an embodiment of the present disclosure may include a preheating operation (S440) and an ice separation position moving operation (S450).

In the ice separating operation (S400), the upper heater 270 and the lower heater 370 are operated so that heat is supplied to the upper tray 210 and the lower tray 310.

In an embodiment of the present disclosure, as described above, since the upper tray 210 is made of a plastic material, thermal conductivity of the upper tray 210 may be lower than thermal conductivity of the lower tray 310 made of a silicone resin. In addition, in the molded product made of such a plastic material, the upper tray 210 and the ice may be more strongly attached to the water friendly during the phase change of water to ice than the silicone resin.

Considering this phenomenon, in an embodiment of the present disclosure, it is assumed that the amount of heat supplied through the upper heater 270 and the lower heater 370, that is, the output of the upper heater 270 and the lower heater 370, is controlled during the preheating process.

As an example, the upper heater 270 may maintain an on state in the process of performing the preheating operation (S440), and the lower heater 370 may adjust the amount of heat supplied to the lower tray 310 through on/off duty control (S441). For example, the lower heater 370 may be controlled to be turned on for 47 seconds and turned off for 14 seconds based on 60 seconds.

That is, the amount of heat supplied by the lower heater 370 in the preheating operation may be set to be less than the amount of heat supplied by the upper heater 270.

On the other hand, in an embodiment of the present disclosure, it is assumed that the preheating operation (S440) is performed for a first preheating time (S442), and after the first preheating time has elapsed, it is determined that the preheating operation is completed when a preset preheating completion condition is satisfied (S443). For example, when the first preheating time is set to 10 minutes, the preheating operation may be ended after 10 minutes according to whether the preheating completion condition is satisfied.

In an embodiment of the present disclosure, when the second preheating time has elapsed, or when the temperature sensed by the temperature sensor 720 provided in the upper tray 210 reaches the preset preheating completion temperature, the preheating completion condition may be set to be satisfied. For example, when the second preheating time is set to 20 minutes, the preheating operation (S440) may be ended, regardless of whether the preheating completion temperature is reached, when 10 minutes have elapsed after the first preheating time of 10 minutes has elapsed again.

On the other hand, even before the second preheating time elapses, when the temperature sensed by the temperature sensor 720 reaches the preheating completion temperature, for example, 7° C., the preheating operation (S440) may be ended.

As described above, when the preheating step (S440) is completed, the controller 710 performs the ice separation position moving operation (S450). That is, the controller 710 controls the driving unit 700 to rotate the lower assembly 300 in the forward direction so as to rotate the lower tray 310 to the ice separation position (S452).

When the lower assembly 300 is rotated in the forward direction, the lower tray 310 is spaced apart from the upper tray 210. In the ice separating process, ice may be separated from the surface of the upper tray 210 by the heat of the upper heater 270.

In an embodiment of the present disclosure, for smooth ice separation, the upper heater and the lower heater are controlled (S451) so as to maintain the on state during the process of performing the ice separation position moving operation (S450). That is, as described above, the output of the upper heater 270 and the lower heater 370 is controlled through the on/off duty control. Therefore, the upper heater 270 and the lower heater 370 may maintain the on state so as to operate at full output.

In the process described above, when the upper ejecting fin 252 presses the ice in close contact with the upper tray 210 and the lower tray 310 is pressed by the lower ejector 360, ice may be separated from the lower tray 310.

The ice separated from the surface of the lower tray 310 may fall downward and may be stored in the ice bin 102.

Through the preheating process described above, an intact ice state, e.g., spherical ice, can be separated without damage to the ice.

In addition, during the preheating process, excessive heat is supplied to the lower tray 310 to prevent melting of ice.

Figure 18:
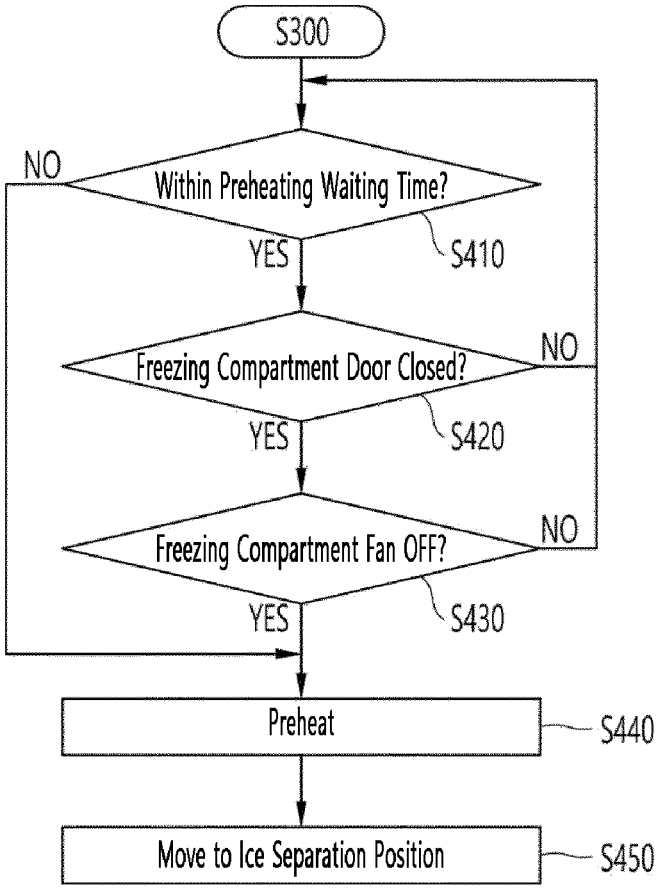
FIG. 18 is a flowchart for describing the ice separating operation according to another embodiment of the present disclosure.

FIG. 18 is a flowchart for describing the ice separating operation according to another embodiment of the present disclosure.

Referring to FIG. 18, the ice separating operation (S400) according to another embodiment of the present disclosure may further include a waiting time detecting operation (S410), a door detecting operation (S420), and a fan detecting operation (430).

When it is determined that the ice making is completed, the controller 710 may detect a waiting time after the completion of the ice making. The controller 710 may determine whether the waiting time after the completion of ice making is within a preset preheating waiting time (S410). The preheating waiting time is a time for which an ice separation defect may occur according to the lapse of time after the completion of ice making, and may be, for example, 60 minutes.

When it is determined that the waiting time has exceeded the preheating waiting time, the controller 710 skips the door detecting operation (S420) and the fan detecting operation (430) and performs the preheating operation (S440) and the ice separation position moving operation (S450). The preheating operation (S440) and the ice separation position moving operation (S450) may correspond to the embodiments described above, and thus descriptions thereof will be omitted.

On the other hand, when the waiting time is within the preheating waiting time, the controller 710 performs the door detecting operation (S420).

The refrigerator 1 may include a door detector 730 that detects whether the freezing compartment door 21 is opened or closed. The door detector 730 may be configured as a type of switch that is compressed by closing the freezing compartment door 21 and is restored by opening the freezing compartment door 21.

When the freezing compartment door 21 is opened, the temperature of the freezing compartment 12 is increased by the influence of the external temperature. In order to lower the increased temperature, the freezing compartment fan 740 operates, and cold air from the evaporator 14 circulates into the freezing compartment 12. The cold air circulating in the freezing compartment 12 may be introduced into the ice chamber IC through a cold air hole 121.

At this time, when the upper heater 270 and the lower heater 370 are operated for ice separation, the upper heater 270 may not transfer sufficient heat necessary for ice separation to the upper chamber 152 due to the influence of the cold air introduced through the cold air hole 121.

Therefore, preferably, the controller 710 checks whether the freezing compartment door 21 is opened or closed, and controls the upper heater 270 and the lower heater 370 to operate in a state where the freezing compartment door 21 is closed.

When it is determined that the freezing compartment door 21 is closed, the controller 710 performs the fan detecting operation (S430) of detecting whether the freezing compartment fan is operating. When it is determined that the freezing compartment door 21 is opened, the controller 710 returns to the waiting time detecting operation (S410) and waits in a state where the ice making is completed.

On the other hand, when the ice making is completed, the controller 710 detects the operating state of the freezing compartment fan before the upper heater 270 and the lower heater 370 are operated for ice separation.

At this time, when it is detected that the operation of the freezing compartment fan is in an off state, the controller 710 may sequentially perform the preheating operation (S440) and the ice separation position moving operation (S450).

On the other hand, when it is detected that the freezing compartment fan 740 is in an on state, the controller 710 returns to the waiting time detecting operation (S410) and waits in a state where the ice making is completed.

Figure 19:
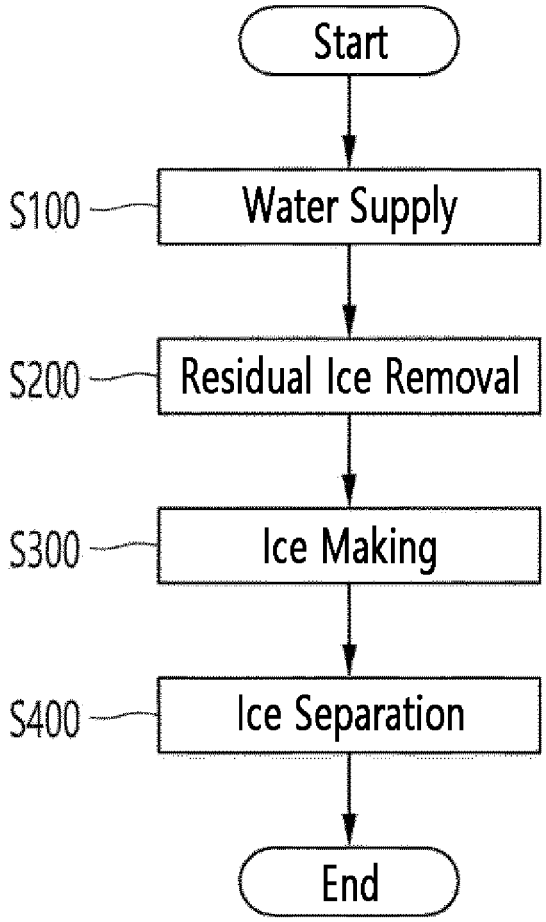
FIG. 19 is a flowchart for describing a process of making ice in the ice maker according to another embodiment of the present disclosure.

FIG. 19 is a flowchart for describing a process of making ice in the ice maker according to another embodiment of the present disclosure.

The ice maker 100 according to another embodiment of the present disclosure may perform a residual ice removing operation (S200) after completion of water supply and before the ice making operation (S300).

In the residual ice removing operation (S200) according to an embodiment of the present disclosure, the controller 710 may control at least one of the upper heater 270 and the lower heater 370 to operate so that heat is supplied to the ice making water in the ice chamber IC.

In an embodiment of the present disclosure, it is assumed that both the upper heater 270 and the lower heater 370 operate in the residual ice removing operation (S200). In addition, it is assumed that both the upper heater 270 and the lower heater 370 are controlled to operate at full output for quick residual ice removal.

As described above, since the output control of the upper heater 270 and the lower heater 370 is performed through the on/off duty control, it is assumed that the upper heater 270 and the lower heater 370 are continuously maintained in an on state while the residual ice removing operation (S200) is performed.

For example, it is assumed that the residual ice removing operation (S200) according to an embodiment of the present disclosure is performed for a preset residual ice removal time. For example, the residual ice removal time may be set to 30 minutes. The residual ice removal time may be set in consideration of conditions such as the output capacity of the upper heater 270 and the lower heater 370 and the size of the ice chamber IC, and the optimal time may be derived through an experimental process.

When the residual ice removing operation (S200) is completed as described above, the controller 710 sequentially performs the ice making operation (S300) and the ice separating operation (S400). The ice making operation (S300) and the ice separating operation (S400) are performed through the above-described process, and a detailed description thereof will be omitted.

Figure 20:
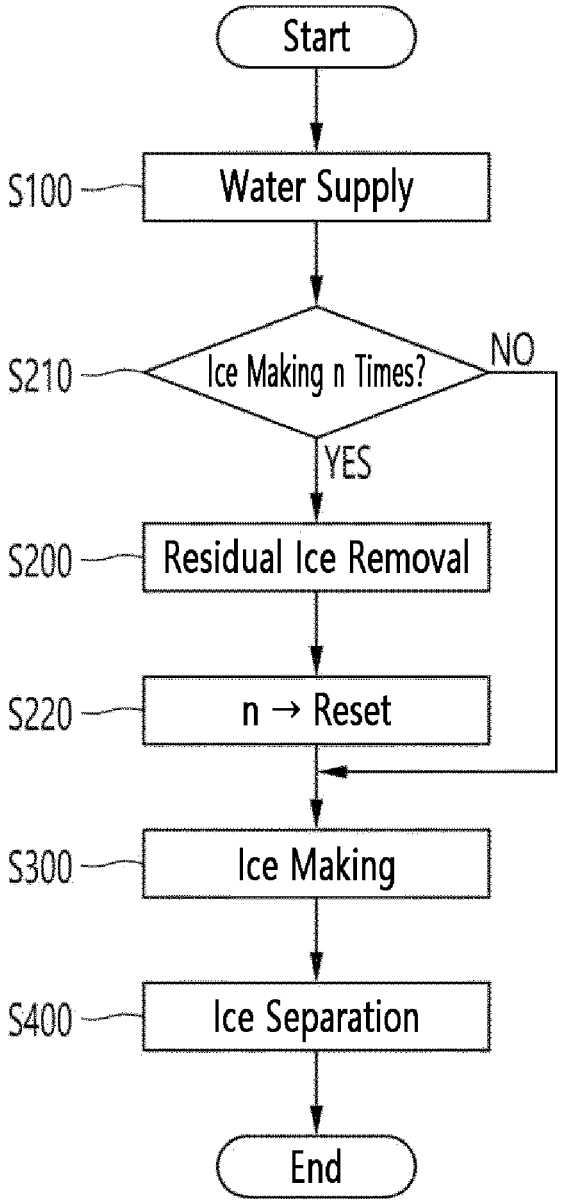
FIG. 20 is a flowchart for describing a process of making ice in the ice maker according to still another embodiment of the present disclosure.

FIG. 20 is a flowchart for describing a process of making ice in the ice maker according to still another embodiment of the present disclosure.

In the embodiment shown in FIG. 20, it is assumed that a residual ice removing operation (S200) is performed each time in the repeating process of a water supply operation (S100), an ice making operation (S300), and an ice separating operation (S400).

On the other hand, in still another embodiment of the present disclosure, the residual ice removing operation (S200) may be performed in units of preset repetition cycles in the repeating process of the water supply operation (S100), the ice making operation (S300), and the ice separating operation (S400).

More specifically, referring to FIG. 20, as described above, when the water supply operation (S100) is completed, the controller 710 may determine whether a preset repetition cycle has elapsed (S210). For example, the controller 710 may determine whether the ice making operation has been repeated n times.

At this time, when the controller 710 determines that the repetition cycle has not elapsed, the controller 710 does not perform the residual ice removing operation (S200), but sequentially performs the ice making operation (S300) and the ice separating operation (S400).

On the other hand, when the controller 710 determines that the repetition cycle has elapsed, that is, when the controller 710 determines that the ice making operation is repeated n times, the controller 710 sequentially performs the ice making operation (S300) and the ice separating operation (S400) after the residual ice removing operation (S200) as described above.

When the residual ice removing operation (S200) is performed, the controller 710 may initialize the value of n, which is the number of repetitions (S220).

As described above, after the supply of water into the ice chamber IC is completed, the upper heater 270 and the lower heater 370 use the supplied ice making water to remove the residual ice, thereby effectively removing the residual ice.

In addition, a residual ice accumulation phenomenon in the repeated ice making may be prevented by performing the residual ice removing operation every time or in units of preset repetition cycles.

Such removal of residual ice makes it possible to make ice, for example, intact ice without damage to the outer shape of the ice.

The embodiments of the present disclosure have been described above with reference to the accompanying drawings, but the present disclosure is not limited to the embodiments and may be manufactured in various different forms. It will be understood by those of ordinary skill in the art that the present disclosure can be implemented in other specific forms without changing the technical spirit or essential features of the present disclosure. Therefore, it should be understood that the embodiments described above are illustrative in all aspects and are not restrictive.

What is claimed is:

1. A refrigerator comprising:

a cabinet that defines a storage space;

a door configured to open or close at least a portion of the storage space; and an ice maker provided in the storage space or the door, wherein the ice maker comprises:

a first tray comprising a first chamber that is configured to define a first portion of an ice chamber, a second tray comprising a second chamber that is configured to define a second portion of the ice chamber, and a heater disposed along a circumference of the first chamber and configured to heat the first chamber, and wherein the first tray further comprises:

a first heat transfer portion that protrudes from the first chamber and that is configured to transfer heat of the heater to the first chamber, and a second heat transfer portion that protrudes from the first chamber and that is configured to transfer the heat of the heater to the first chamber, and wherein the second heat transfer portion is configured to surround at least one region around the first chamber.

2. The refrigerator of claim 1, wherein the ice maker further comprises a first case to which the first tray is coupled.

3. The refrigerator of claim 2, wherein the second tray is rotatably supported to the first case.

4. The refrigerator of claim 2, wherein the first heat transfer portion includes a first contact end in contact with a portion of the heater, wherein the second heat transfer portion includes a second contact end in contact with another portion of the heater, and wherein a distance between the first contact end and the second tray in an arrangement direction of the first and second trays is greater than a distance between the second contact end and the second tray in the arrangement direction of the first and second trays.

5. The refrigerator of claim 2, wherein a first contact end of the first heat transfer portion comes into contact with the heater when the first case is coupled to the first tray, and wherein a first region where the first heat transfer portion is in contact with the first chamber is wider than a second region where the first heat transfer portion is in contact with the heater.

6. The refrigerator of claim 2, wherein the first case comprises a heater insertion portion disposed at a position corresponding to the first heat transfer portion and the second heat transfer portion and into which the heater is inserted so that the heater is exposed toward the first tray.

7. The refrigerator of claim 6, wherein the heater insertion portion comprises:

a first heater insertion portion into which the first heat transfer portion is inserted; and a second heater insertion portion into which the second heat transfer portion is inserted, wherein the heater is inserted into the first heater insertion portion and the second heater insertion portion, and wherein a region of the heater inserted into the second heater insertion portion is located closer to the second tray than a region of the heater inserted into the first heater insertion portion.

8. The refrigerator of claim 7, wherein the first case further comprises:

a tray opening through which a portion of the first chamber passes when coupled to the first tray; and an opening wall extending from at least a region of the tray opening, wherein the first heater insertion portion protrudes radially inward from an inner wall of the opening wall, and wherein the second heater insertion portion is formed in at least a region of a distal end of the opening wall.

9. The refrigerator of claim 1, wherein the first heat transfer portion protrudes from a first heating region of the first chamber, wherein the second heat transfer portion protrudes from a second heating region of the first chamber, and wherein a horizontal distance between a portion of the first chamber at the first heating region and a vertical line passing through a center of the ice chamber is less than a horizontal distance between a portion of the first chamber at the second heating region and the vertical line passing through the center of the ice chamber.

10. The refrigerator of claim 9, wherein the first heating region is defined at a region where the first heat transfer portion and the first chamber meet each other, and wherein the second heating region is defined at a region where the second heat transfer portion and the first chamber meet each other.

11. The refrigerator of claim 1, wherein the heater comprises:

a first portion that is in contact with the first heat transfer portion; and a second portion that is in contact with the second heat transfer portion.

12. The refrigerator of claim 1, wherein the first tray comprises a plurality of first chambers including the first chamber, and wherein the first heat transfer portion is formed in each of the plurality of first chambers, and at least one first heat transfer portion is formed between a pair of the first chambers adjacent to each other.

13. The refrigerator of claim 1, wherein the first heat transfer portion comprises:

a chamber contact portion extending from the first chamber; and a heater contact portion extending from the chamber contact portion and having a horizontal length shorter than a horizontal length of the chamber contact portion.

14. The refrigerator of claim 1, further comprising an auxiliary heat transfer portion extending outward from the second heat transfer portion in a radial direction of the first chamber.

15. The refrigerator of claim 1, wherein the first tray is made of a plastic material, and wherein the second tray is made of an elastic material.

16. An ice maker comprising:

a first tray comprising a first chamber that is configured to define a first portion of an ice chamber;

a first case coupled to the first tray from one side of the first tray;

a second tray comprising a second chamber that is configured to define a second portion of the ice chamber based on being in contact with the first chamber; and a heater disposed along a circumference of the first chamber, wherein the first tray further comprises:

a first heat transfer portion that protrudes from the first chamber and that is configured to transfer heat of the heater to the first chamber, and a second heat transfer portion that protrudes from the first chamber and that is configured to transfer the heat of the heater to the first chamber, wherein the first case comprises a heater insertion portion into which the heater is inserted, wherein the heater insertion portion comprises:

a first heater insertion portion into which a portion of the heater is inserted, and a second heater insertion portion into which another portion of the heater is inserted, and wherein a region of the heater inserted into the second heater insertion portion is located closer to the second tray than a region of the heater inserted into the first heater insertion portion.

17. The ice maker of claim 16, wherein the first chamber includes an inlet port, and wherein the first heat transfer portion is disposed closer to the inlet port than the second heat transfer portion.

18. The ice maker of claim 16, wherein the first heat transfer portion includes a first contact end in contact with the portion of the heater, wherein the second heat transfer portion includes a second contact end in contact with the other portion of the heater, and wherein a distance between the first contact end and the second tray in an arrangement direction of the first and second trays is greater than a distance between the second contact end and the second tray in the arrangement direction of the first and second trays.

19. The ice maker of claim 18, wherein a first heating region is defined at a region where the first heat transfer portion and the first chamber meet each other, wherein a second heating region is defined at a region where the second heat transfer portion and the first chamber meet each other, and wherein the second heating region is wider than the first heating region.

20. A refrigerator comprising:

a cabinet that defines a storage space;

a door configured to open or close at least a portion of the storage space; and an ice maker provided in the storage space or the door, wherein the ice maker comprises:

a first tray comprising a first chamber that is configured to define a first portion of an ice chamber, a second tray comprising a second chamber that is configured to define a second portion of the ice chamber, and a heater disposed along a circumference of the first chamber and configured to heat the first chamber, wherein the first tray further comprises:

a first heat transfer portion that protrudes from the first chamber and that has a first contact end in contact with a portion of the heater, and a second heat transfer portion that protrudes from the first chamber and that has a second contact end in contact with another portion of the heater, and wherein a distance between the first contact end and the second tray in an arrangement direction of the first and second trays is greater than a distance between the second contact end and the second tray in the arrangement direction of the first and second trays.

21. The refrigerator of claim 20, wherein the first chamber includes an inlet port, and wherein the first heat transfer portion is disposed closer to the inlet port than the second heat transfer portion.

* * * * *